US011535039B2

(12) United States Patent
Kawahara et al.

(10) Patent No.: US 11,535,039 B2
(45) Date of Patent: Dec. 27, 2022

(54) EJECTION-MATERIAL EJECTION APPARATUS AND IMPRINTING APPARATUS

(71) Applicant: CANON KABUSHIKI KAISHA, Tokyo (JP)

(72) Inventors: Nobuto Kawahara, Utsunomiya (JP); Yoshimasa Araki, Yokohama (JP); Yuichi Iwasaki, Utsunomiya (JP); Noriyasu Hasegawa, Utsunomiya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 218 days.

(21) Appl. No.: 16/766,384

(22) PCT Filed: Nov. 28, 2018

(86) PCT No.: PCT/JP2018/043683
§ 371 (c)(1),
(2) Date: May 22, 2020

(87) PCT Pub. No.: WO2019/107383
PCT Pub. Date: Jun. 6, 2019

(65) Prior Publication Data

US 2021/0362507 A1 Nov. 25, 2021

(30) Foreign Application Priority Data

Nov. 30, 2017 (JP) ..... JP2017-230287
Nov. 30, 2017 (JP) ..... JP2017-230766
(Continued)

(51) Int. Cl.
*B41J 2/175* (2006.01)
*B05C 11/10* (2006.01)
*B41J 2/19* (2006.01)

(52) U.S. Cl.
CPC ..... *B41J 2/17566* (2013.01); *B05C 11/1002* (2013.01); *B41J 2/17513* (2013.01);
(Continued)

(58) Field of Classification Search
CPC ..... B41J 2/17566; B41J 2/17513
See application file for complete search history.

(56) References Cited

U.S. PATENT DOCUMENTS 5,188,515 A 2/1993 Horn
8,235,482 B2 * 8/2012 Katada ..... B41J 2/17596 347/85
(Continued)

FOREIGN PATENT DOCUMENTS

EP 2 857 205 A2 4/2015
JP 37-005022 Y 3/1962
(Continued)

OTHER PUBLICATIONS

Notification of Reason for Refusal in Korean Application No. 10-2020-7015462 (dated Jan. 2021).
(Continued)

*Primary Examiner* — Sharon Polk
(74) *Attorney, Agent, or Firm* — Venable LLP

(57) ABSTRACT

An ejection-material ejection apparatus and an imprinting apparatus are provided which are capable of quickly detecting damage of a flexible membrane and avoiding contact between an ejection material and an operating liquid even if part of the flexible membrane is damaged. The flexible membrane includes a first film (1) covering a first storing space (5) for the ejection material, a second film (2) covering a second storing space (6) for the operating liquid, and an inter-film space 4 situated between the first film (1) and the second film (2). A change in state of the inter-film space (4) resulting from communication between at least one of the
(Continued)

first storing space (5) and the second storing space (6) and the inter-film space (4) is detected with a liquid sensor (41), a flow speed sensor (77), and a liquid leakage sensor (42).

20 Claims, 32 Drawing Sheets

(30) Foreign Application Priority Data

Jul. 20, 2018 (JP) ..... JP2018-136707
Oct. 22, 2018 (JP) ..... JP2018-198690

(52) U.S. Cl.
CPC ..... *B41J 2/17556* (2013.01); *B41J 2/19* (2013.01); *B41J 2002/17516* (2013.01); *B41J 2002/17573* (2013.01)

(56) References Cited

U.S. PATENT DOCUMENTS

| | | | |
|---|---|---|---|
| 9,340,032 | B2 | 5/2016 | Araki et al. |
| 9,475,303 | B2 | 10/2016 | Araki et al. |
| 9,834,002 | B2 | 12/2017 | Araki et al. |
| 9,952,506 | B2 | 4/2018 | Arai et al. |
| 10,421,283 | B2 | 9/2019 | Araki et al. |
| 10,518,546 | B2 | 12/2019 | Araki et al. |
| 10,634,995 | B2 | 4/2020 | Minoda et al. |
| 10,987,840 | B2 * | 4/2021 | Iwasaki ..... B29C 45/7626 |
| 2016/0026084 | A1 | 1/2016 | Arai et al. |
| 2017/0329217 | A1 | 11/2017 | Minoda et al. |
| 2020/0338806 | A1 | 10/2020 | Kawahara et al. |
| 2020/0376851 | A1 | 12/2020 | Kuri et al. |

FOREIGN PATENT DOCUMENTS

| | | | |
|---|---|---|---|
| JP | 4-252880 | A | 9/1992 |
| JP | 2015-092549 | A | 5/2015 |
| JP | 2016-032103 | A | 3/2016 |
| JP | 2016-196128 | A | 11/2016 |
| JP | 2016-196129 | A | 11/2016 |
| KR | 10-2016-0012959 | A | 2/2016 |
| WO | 2015/046197 | A1 | 4/2015 |

OTHER PUBLICATIONS

Kawahara et al., U.S. Appl. No. 16/838,254, filed Apr. 2, 2020.
Kuri et al., U.S. Appl. No. 16/880,026, filed May 21, 2020.
Notification of Reasons for Refusal in Japanese Application No. 2018-198690 (dated Nov. 2022).

* cited by examiner

EJECTION-MATERIAL EJECTION APPARATUS AND IMPRINTING APPARATUS

TECHNICAL FIELD

The present invention relates to an ejection apparatus that ejects a liquid or liquid-like ejection material and to an imprinting apparatus including the ejection apparatus.

BACKGROUND ART

As for an ejection apparatus that ejects a liquid or liquid-like ejection material stored in a storing container from an ejection head, PTL 1 describes a configuration using a storing container partitioned into two storing portions by a flexible member. One of the storing portions in the storing container stores the ejection material, while the other storing portion stores a liquid, and the internal pressure of the other storing portion is controlled to indirectly adjust the internal pressure of the one storing portion. Inside such a storing container, the internal pressures of the one storing portion and the other storing portion are equalized to each other. For this reason, even if the flexible member is damaged, the internal pressures will remain unchanged. This makes it difficult to detect the occurrence of the damage.

To address this, PTL 2 describes a configuration in which the other storing portion stores a liquid that differs in physical property from the ejection material and does not get mixed with the ejection material, and which detects damage of the flexible member by detecting a change in physical property of the liquid that occurs when the ejection material enters the other storing portion.

CITATION LIST

Patent Literature

[PTL 1]
Japanese Patent Laid-Open No. 2015-092549
[PTL 2]
Japanese Patent Laid-Open No. 2016-032103

SUMMARY OF INVENTION

Technical Problem

However, according to the configuration of PTL 1, the ejection material and the liquid, stored in the respective storing portions, are limited to ejection materials and liquids having detectable different physical properties. Also, once the flexible member is damaged, the ejection material and the liquid start contacting each other through the damaged spot, but it will take time before the change in physical property of the liquid becomes detectable after the start of the contact. For this reason, the damage of the flexible member cannot be detected immediately after its occurrence. Further, even without being mixed with the liquid, a certain kind of ejection material may be deteriorated in quality by simply contacting the liquid. In that case, if the ejection material having contacted the liquid is ejected, products with deteriorated quality will keep being manufactured as long as this ejection material is ejected from the ejection head.

In addition, physical properties of the ejection material inside its storing portion may possibly change even if the storing portion is damaged at a spot other than the flexible member.

The present invention provides an ejection-material ejection apparatus and an imprinting apparatus capable of quickly detecting damage of a flexible membrane and avoiding contact between an ejection material and a liquid even if part of the flexible membrane is damaged.

Solution to Problem

An ejection-material ejection apparatus of the present invention comprises:

- an ejection head configured to eject an ejection material;
- a storing container configured to be separated by a flexible membrane into a first storing space storing the ejection material to be supplied to the ejection head, and a second storing space storing an operating liquid; and
- a first pressure controller configured to control internal pressure of the second storing space,
- wherein the flexible membrane includes a first film covering the first storing space, a second film covering the second storing space, and an inter-film space situated between the first film and the second film, and
- the ejection-material ejection apparatus further comprises a detector configured to detect a change in state of the inter-film space resulting from communication between at least one of the first storing space and the second storing space and the inter-film space.

Advantageous Effects of Invention

According to the present invention, the flexible membrane has a two-layer structure with the first film and the second film. Thus, it is possible to avoid contact between the ejection material and the operating liquid even if one of the first film and the second film is damaged. Moreover, with the inter-film space between the first film and the second film, it is possible to quickly detect damage of at least one of the first film and the second film by detecting a change in state of the inter-film space.

Further features of the present invention will become apparent from the following description of exemplary embodiments with reference to the attached drawings.

DESCRIPTION OF EMBODIMENTS

Preferred embodiments of the present invention will now be described based on the accompanying drawings.

First Embodiment (Configuration of Ejection-Material Ejection Apparatus)

Figure 1:
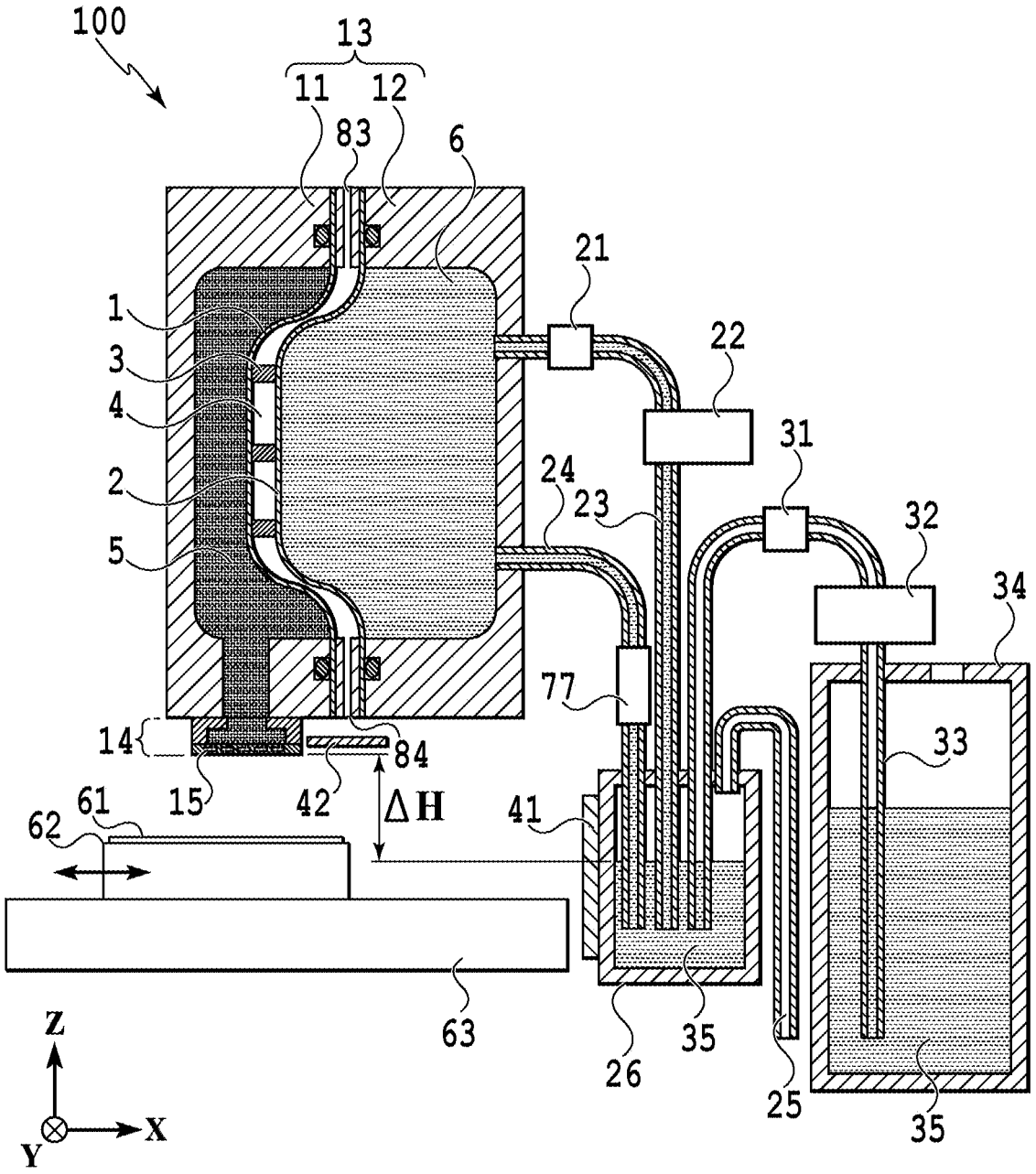
FIG. 1 is a configuration diagram of an ejection apparatus in a first embodiment of the present invention.

FIG. 1 is a schematic configuration diagram of an ejection-material ejection apparatus (hereinafter, also referred to simply as 'ejection apparatus') in a first embodiment of the present invention.

The ejection apparatus in this embodiment includes a main tank 34 communicating with the atmosphere and holding an operating liquid 35 therein, a sub tank 26 communicating with the atmosphere, being capable of communicating with the main tank 34, and holding an operating liquid 35 therein, and an ejection-material storing unit 100 communicating with the sub tank 26. The ejection-material storing unit 100 includes a storing container 13 storing an ejection material and an ejection head 14 mounted to the storing container 13. Note that the storing container 13 and the ejection head 14 may be configured as separate components or configured integrally with each other. The storing container 13 may be of a cartridge type. The ejection head 14 can eject the ejection material from ejection ports 15 opening at the outer surface (ejection surface) of the ejection head. The ejection ports 15 in this embodiment are arranged on the ejection surface of the ejection head 14 at a density of 500 to 1000 ports per inch.

As illustrated in FIG. 1, a conveyance unit 62 mounted on a base plate 63 is disposed so as to face the ejection surface of the ejection head 14. The conveyance unit 62 can hold a medium 61, which is an object to apply the ejection material, by attracting it with an attractor not illustrated and move on the base plate 63 to thereby move the medium 61 relative to the ejection head 14. The ejection material stored in the storing container 13 is ejected from the ejection ports 15 of the ejection head 14 onto an ejection-material application region on the medium 61 conveyed to a position where the medium 61 faces the ejection ports 15. As a result, a desired ejection-material pattern (e.g. print image) is formed.

(Ejection Material)

The ejection material is a material that does not have a fixed shape but exhibits fluidity unlike solids and does not undergo significant volume change unlike gases when it is inside the storing container 13 and also when it is ejected from the ejection head 14, and is a liquid or liquid-like material. The ejection material may be a material such as a material in past form or a polymetric material. Ink is usable as the ejection material in this embodiment. Non-limiting examples of the ink include various inks such as ink for printing images, electrically conductive ink for fabricating electric circuits, and UV-curable ink. Examples of the electrically conductive ink include inks containing metal particles, in particular, metal nano-inks containing metal nanoparticles of several to several tens of nanometers dispersed in a liquid, e.g. silver nano-ink. For fabrication processes of semiconductor devices and the like, there is a so-called imprinting technique, in which a mold with a pattern formed thereon is brought into contact with an imprint material on a substrate to thereby transfer the shape of the mold into the imprint material and form the pattern therein. A resist such as photocurable resin or thermosetting resin is used as the imprint material. Other examples of the ejection material include imprint materials as above as well.

(Operating Liquid)

The operating liquid is an incompressible material whose density (volume) change upon receipt of external temperature and pressure is negligibly small as compared to that of gases. Thus, the volume of the operating liquid hardly changes even when the temperature or pressure of the air around the ejection apparatus changes. A material selected from among liquids like water and materials in gel form is usable as the operating liquid, for example. Usually, the difference between the density of the ejection material and the density of the operating liquid is smaller than the difference between the density of the ejection material and the density of gas.

In the case of using the ejection apparatus according to the present invention as an ink ejection apparatus of a printing apparatus, for example, ink is used as the ejection material as a matter of course. On the other hand, ink, which is costly, does not need to be used as the operating liquid but water, which has a close relative density to ink, can be used instead. More specifically, water in which an additive with a preservative function is added to prevent decomposition and growth of bacteria in water can be used as the operating liquid.

(Configuration of Control System of Ejection Apparatus)

Figure 2:
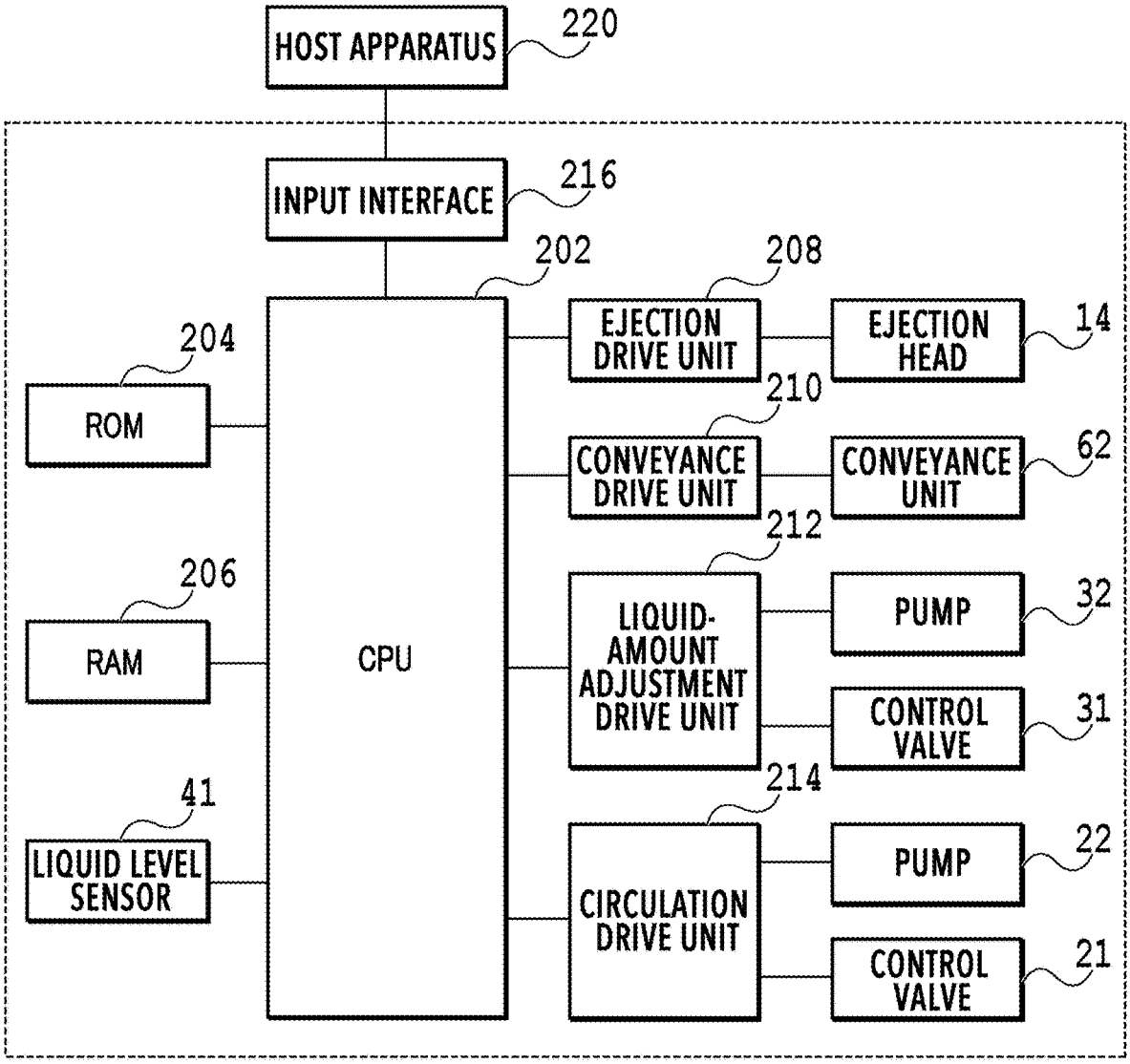
FIG. 2 is a block diagram of a control system of the ejection apparatus in FIG. 1.

FIG. 2 is a diagram for explaining a control system of the ejection apparatus according to this embodiment.

By following a control program stored in an ROM 204, a CPU 202 drives the conveyance unit 62 by means of a conveyance drive unit 210 and drives the ejection head 14 by means of an ejection drive unit 208. Also, by following the control program stored in the ROM 204, the CPU 202 drives a control valve 31 and a pump 32 by means of a liquid-amount adjustment drive unit 212 based on a detection result from a liquid level sensor 41 provided on the sub tank 26, as will be described later. Further, by following the control program stored in the ROM 204, the CPU 202 drives a control valve 21 and a pump 22 by means of a circulation drive unit 214, as will be described later. Information such as ejection data (print data) is input from a host apparatus 220 through an input interface 216, and that input information is written to an RAM 206.

(Configuration of Ejection Head)

Figure 3:
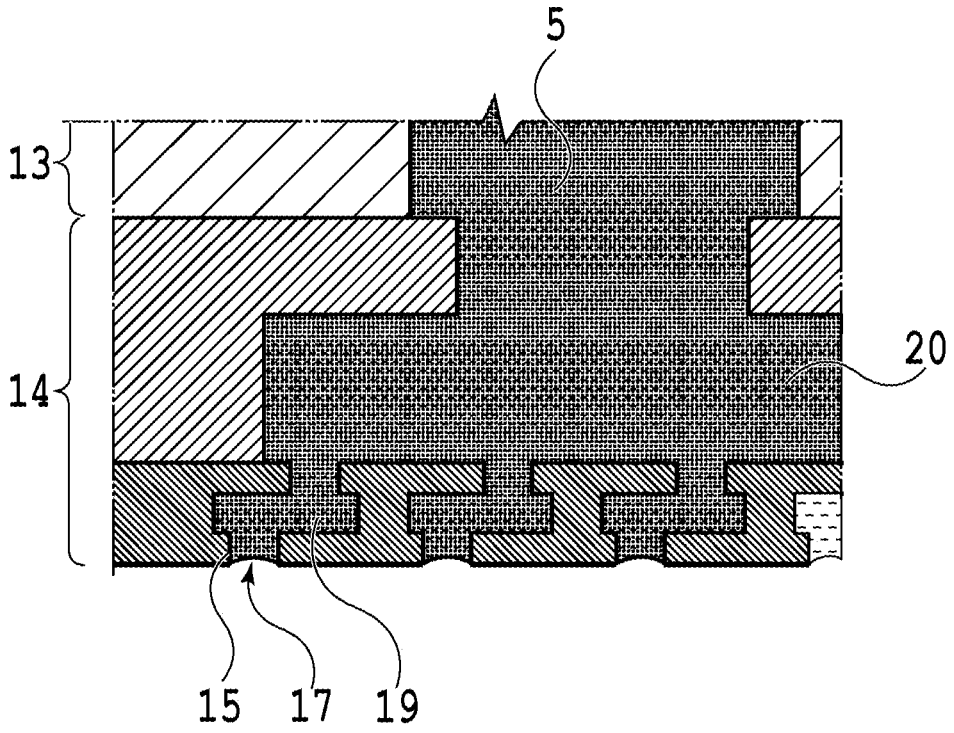
FIG. 3 is a cross-sectional view of a main part of an ejection head in FIG. 1.

FIG. 3 is an enlarged view of some ejection ports 15 in the ejection head 14 and their surroundings.

In the ejection head 14, an actuator (not illustrated) is installed in each of pressure chambers 19 provided individually for the ejection ports 15. The actuator may only need to be an element capable of generating energy with which the ejection material can be ejected in a fine droplet, e.g. a droplet of 1 picolitre (pL). Specific examples of the actuator include a piezoelectric element, a heat element, and so on. A piezoelectric element is usable under high temperature conditions since the influence of temperature change (temperature rise) on ejection characteristics is smaller when a piezoelectric element is used than when a heat element is used. Thus, various kinds of ejection materials such as resins with high viscosity are usable. Also, generally, when a heat element is used, the manufacturing cost can be lower. The actuator in this embodiment is a piezoelectric element. By controlling drive of the piezoelectric element, the capacity of the pressure chamber 19 is changed to eject the ejection material in the pressure chamber 19 from the ejection port 15. The piezoelectric element may be installed using a micro electro mechanical system (MEMS) technique.

Each pressure chamber 19 communicates with a common liquid chamber 20, and this common liquid chamber 20 communicates with a first storing space 5 in the storing container 13. The ejection material to be ejected from the ejection ports 15 is supplied to the pressure chambers 19 from the first storing space 5 through the common liquid chamber 20. The ejection head 14 has no control valve between itself and the first storing space 5. For this reason, the internal pressure of the first storing space 5 is controlled to be a negative pressure slightly lower than the atmospheric pressure outside the ejection ports 15 of the ejection head 14 (outside air pressure). This negative-pressure control allows the ejection material in each ejection port 15 to form a meniscus 17 at its interface with the outside air, and thereby prevents leakage (dripping) of the ejection material from the ejection port at an unintended time. In this embodiment, the internal pressure of the first storing space 5 is controlled to be a negative pressure lower than the outside air pressure by 0.40±0.04 kPa.

(Configuration of Storing Container)

As illustrated in FIG. 1, the exterior and the internal capacity of the storing container 13 are defined by a housing 11 and a housing 12. A flexible member (flexible membrane) is disposed between the housing 11 and the housing 12. The flexible member is a multi-layer structure having a layered configuration with two flexible films (first film 1 and second film 2). The first film 1 and the second film 2 are each a thin film with a thickness of 10 to 100 micrometers and are link to each other at linking portions 3 with adhesive or by a technique such as fusing. The linking portions 3 are provided partly on the surfaces of the first film 1 and the second film 2 facing each other, so that the first film 1 and the second film 2 have non-connected regions at which they are not connected to each other.

The housing 11 has a first opening portion opening on the side that faces the housing 12, and a second opening portion opening on the side that faces the ejection head 14. The entire plane of the first opening portion is covered and sealed by the first film 1, and the first storing space 5 is formed between the inner surface of the housing 11 and the first film 1. The second opening portion communicates with the common liquid chamber 20 in the ejection head 14, so that the first storing space 5 communicates with the outside space through the ejection head 14. The first storing space 5 is filled with the ejection material, and the interface between the ejection material and the outside air is situated inside the ejection ports 15, as illustrated in FIG. 3.

The housing 12 has an opening portion opening on the side that faces the housing 11. The entire plane of this opening portion is covered and sealed by the second film 2, and a second storing space 6 is formed between the inner surface of the housing 12 and the second film 2. The second storing space 6 is filled with the operating liquid 35. Also, the second storing space 6 communicates with the inside of the sub tank 26 through a tube 24 and can communicate with the inside of the sub tank 26 also through a tube 23 equipped with the control valve 21 and the pump 22. The sub tank 26 is a liquid storing unit that holds the operating liquid 35. Inside the second storing space 6, the operating liquid 35 functions as a liquid filler. The first film 1 and the second film 2 each function as a barrier between the first storing space 5 and the second storing space 6.

(Materials of Films)

The materials of the first film 1 and the second film 2 may only need to be materials resistant to the ejection material and the operating liquid in view of the liquid contact property and the like. For example, tetrafluoroethylene-perfluoroalkyl vinyl ether copolymer (PFA), ethylene tetrafluoroethylene (ETFE), and a Teflon (registered trademark)-based fluororesin such as polytetrafluoroethylene (PTFE) are usable. Also, examples include polyethylene (PE), polyvinyl chloride (PVC), polyethylene terephthalate (PET), polyvinyl alcohol (PVAL), polyvinylidene chloride (PVDC), and a polyamide synthetic resin such as nylon. The first film 1 and the second film 2 may be of the same material (substance and thickness) or of different materials. For example, it is possible to use a material resistant to the ejection material, such as PTFE, for the first film 1 and use a nylon-based material resistance to the operating liquid for the second film 2.

(Relation Between Pressure in First Storing Space and Pressure in Second Storing Space)

Whenever a difference in internal pressure is produced between the first storing space 5 and the second storing space 6, the first film 1 and the second film 2, each of which has flexibility, move as a single body toward the side with the lower internal pressure and stop moving when the difference in internal pressure disappears. In this way, the internal pressures of the first storing space 5 and the second storing space 6 can be maintained equal to each other.

To give a more specific description, as the ejection material is ejected from the ejection head 14, the volume of the ejection material inside the first storing space 5 decreases by the amount of the ejected ejection material, so that the internal pressure of the first storing space 5 drops. At the same time, the internal pressure of the second storing space 6 becomes higher than the internal pressure of the first storing space 5. Since the flexible first film 1 and second film 2 are linked to each other by the linking portions 3 so as to be movable together, they move as a single body toward the first storing space 5. Simultaneously, the operating liquid 35 is sucked from the sub tank 26 into the second storing space 6 through the tube 24. As a result, the internal pressures of the first storing space 5 and the second storing space 6 become equal to each other into an equilibrium state again.

As illustrated in FIG. 1, the sub tank 26 communicates with the outside space through a tube 25, and its internal pressure is therefore equal to the atmospheric pressure. The tube 24, through which the inside of the sub tank 26 and the second storing space 6 communicate with each other, is filled with the operating liquid 35. Also, the position of the liquid level of the operating liquid 35 in the sub tank 26 in the vertical direction (hereinafter, also referred to as 'the height of the liquid level') is set to a position lower than the ejection ports 15 of the ejection head 14. The height difference (distance in the vertical direction) between the position of the liquid level of the operating liquid 35 inside the sub tank 26 and the position of the ejection surface, at which the ejection ports 15 open, is Δ H. In this embodiment, the difference Δ H is set so as to maintain the state where the meniscus 17 of the ejection material is formed in each ejection port 15 (the state illustrated in FIG. 3). In other words, the difference Δ H is set such that the ejection material will not leak or drip to the outside from the ejection ports 15 or the meniscus 17 will not excessively recede inward (e.g. to the vicinity of the common liquid chamber). Specifically, the height difference Δ H is set to 41±4 mm so that the internal pressure of the first storing space 5 can be controlled to be a value lower than the outside air pressure by 0.40±0.04 kPa.

This embodiment is an ejection-material ejection apparatus applicable to a printing apparatus capable of ejecting a liquid amount of about 1 pL or less, as mentioned above. In this embodiment, the ejection material is ink for printing images, and the diameter of the ejection ports 15 is about 10 micrometer (μm). Also, in this embodiment, each of the ejection material and the operating liquid has a density substantially equal to that of water. In this embodiment, the height difference Δ H is set within the above-mentioned range of 41 mm±4 mm to form the meniscus 17 of the ejection material inside each ejection port 15 under the above conditions. Also, for example, the diameter of the ejection ports 15 in low-resolution printing apparatuses is several tens of μm, and the diameter of the ejection ports in three-dimensional printers using resin or the like as the ejection material is several hundreds of μm. Thus, the diameter of the ejection ports 15 varies by the type of apparatus to which the ejection apparatus is applied, and physical properties of the ejection material (e.g. density, viscosity, etc.) also vary by the type of apparatus to which the ejection apparatus is applied. Hence, the height difference Δ H is set as appropriate for the apparatus to which the ejection apparatus is applied, by taking the influence of the gravity, capillary force, surface tension, and so on into account.

(Corrective Operation)

A corrective operation is executed when the height of the liquid level of the operating liquid inside the sub tank 26 deviates from the height of a reference liquid level (in this embodiment, a height lower than the ejection ports 15 by 41 mm) outside a predetermined range (in this embodiment, the range of the height of the reference liquid level±4 mm). This corrective operation is a 'liquid level adjustment' operation of putting the height of the liquid level of the operating liquid inside the sub tank 26 within the predetermined range by moving the operating liquid between the main tank 34 and the sub tank 26.

The liquid level sensor 41 is installed on the sub tank 26. The liquid level sensor 41 in this embodiment is a sensor capable of detecting the height of the liquid level of the operating liquid inside the sub tank 26 and its change (displacement). The main tank 34 and the sub tank 26 can communicate with each other through a tube 33 equipped with the control valve 31 and the pump 32. By driving the control valve 31 and the pump 32, the height of the liquid level of the operating liquid inside the sub tank 26 is controlled to be within a desired range (liquid level adjustment). Specifically, when the liquid level sensor 41 detects that the height of the liquid level of the operating liquid 35 inside the sub tank 26 has dropped below the predetermined range, the control valve 31 is opened and the pump 32 is driven to supply the operating liquid from the main tank 34 to the sub tank 26. Further, when the liquid level sensor 41 detects that the height of the liquid level of the operating liquid 35 inside the sub tank 26 is within the predetermined range, the drive of the pump 32 is stopped and the control valve 31 is closed to stop the supply of the operating liquid from the main tank 34 to the sub tank 26. Also, the control valve 31 and the pump 32 can be controlled to supply the operating liquid back from the sub tank 26 to the main tank 34. In this way, the height of the liquid level inside the sub tank 26 is maintained within the predetermined range.

(Sub Tank)

The sub tank 26 is preferably disposed such that the ceiling surface (the uppermost portion in the vertical direction) of its inside is disposed lower than the ejection ports 15 of the ejection head 14 in the vertical direction. With this arrangement, the position of the liquid level of the operating liquid 35 inside the sub tank 26 will not be higher than the position of the ejection ports 15 at the ejection surface even if the operating liquid is supplied from the main tank 34 until the sub tank 26 becomes full in the above liquid level adjustment. In other words, the ceiling surface of the sub tank 26 limits the height of the liquid level of the operating liquid 35 inside the sub tank 26, so that the relative positional relation (height relation) between the liquid level of the operating liquid 35 and the ejection ports in the vertical direction is maintained and the height difference Δ H will never reach 0 (zero). Hence, the internal pressures of the first storing space 5 and the second storing space 6 can always be maintained at negative pressure relative to the outside air pressure, thereby making it possible to prevent leakage and dripping of the ejection material from the ejection ports 15.

(Circulation System)

The second storing space 6 and the sub tank 26 communicate with each other through the tube 24, and can communicate with each other also through the tube 23, which is equipped with the control valve 21 and the pump 22. Bubbles may possibly enter the tube 24 when the storing container 13 is demounted once from the ejection apparatus and then mounted again. In that case, the bubbles in the tube 24 can be removed by opening the control valve 21 and actuating the pump 22 to circulate the operating liquid 35 through the tube 24, the second storing space 6, and the tube 23 and thereby send the operating liquid to the sub tank 26. The control valve 21 is closed while the pump 22 is not used, and is opened while the pump 22 is used.

(Pump)

Examples of the pump 22 and the pump 32 include syringe pumps, tube pumps, diaphragm pumps, gear pumps, and so on. However, the pump 22 and the pump 32 may only need to have the function of a liquid sender and are therefore not limited to pumps. Thus, it is possible to select liquid senders suitable for the ejection-material ejection apparatus.

(First Film 1 and Second Film 2)

As described earlier, the space inside the storing container 13 is separated into the first storing space 5 and the second storing space 6 by the flexible member with the two films 1 and 2, which function as barriers. In this embodiment, the first film 1 and the second film 2 move together and can therefore deform and move as a single body. This makes it possible to control the pressure inside the ejection head 14. If the first film 1 and the second film 2 were not link to each other and could be deformed and moved independently, the pressure inside the ejection head 14 could not be controlled as described above though adjustment of the height of the liquid level of the operating liquid inside the sub tank 26.

A specific case will be described in which an attempt is made to adjust the position of the liquid level (the height of the liquid level) of the operating liquid inside the sub tank 26 to a position lower than the position of the ejection surface, at which the ejection ports 15 open, in a configuration where the first film 1 and the second film 2 can be deformed and moved independently. In this case, the operating liquid inside the second storing space 6 attempts to move by gravity into the sub tank 26 below the second storing space 6 in the vertical direction. Since the second film 2 is movable independently of the first film 1, it moves away from the first film 1 in the X direction in FIG. 1 as the operating liquid 35 inside the second storing space 6 moves to the sub tank 26. If this movement of the operating liquid 35 makes the height difference Δ H excessively small, the pump 32 will be caused to send the operating liquid 35 inside the sub tank 26 to the main tank 34 by the function of adjusting the liquid level inside the sub tank 26. Otherwise, the operating liquid 35 inside the sub tank 26 will overflow to the outside from the tube 25, which communicates with the atmosphere and functions also as an air suction port of the sub tank 26. In either case, there will eventually be no more operating liquid to flow out from the second storing space 6, and the second film 2 will be separated from the first film 1 and attached to the inner wall surface of the housing 12. During the above, the first film 1 is independent of the second film 2 and does not therefore move, so that the internal pressure of the first storing space 5 remain unchanged.

As described above, with the configuration in which the first film 1 and the second film 2 do not move together, the pressure inside the ejection head 14 cannot be controlled through adjustment of the position of the liquid level of the operating liquid 35.

In contrast, in the embodiment of the present invention, the first film 1 and the second film 2 are connected to each other at multiple positions by the linking portions 3, which are distributed on the surfaces of the first film 1 and the second film 2 facing each other, so that the first film 1 and the second film 2 move together in the same direction at the same time. This makes it possible to control the pressure inside the ejection head 14.

Specifically, the first storing space 5 communicates with the outside air through the ejection ports 15 of the ejection head and, at the interface between the ejection material in each of the ejection ports and the outside air, the ejection material is subjected to forces such as the atmospheric pressure, the gravity on the ejection material, and the flow resistance and surface tension by the inner wall of the ejection port. The balance between these forces is such that the ejection material tries to flow out from the ejection port and move the first film 1 in the—X direction, which is opposite from the X direction in FIG. 1. In this embodiment, the force that tries to move the second film 2 in the X direction in FIG. 1 and the force that tries to move the first film 1 in the −X direction are balanced to maintain a state where the internal pressures of the first storing space 5 and the second storing space 6 are equal. Thus, by maintaining the height difference Δ H within the predetermined range, the internal pressures of the first storing space 5 and the second storing space 6 are balanced so as to maintain negative pressure for forming an appropriate meniscus 17 in each ejection port 15. Hence, the pressure inside the ejection head 14 can be controlled by adjusting the position of the liquid level of the operating liquid 35 inside the sub tank 26.

(Storing Container)

Figure 4:
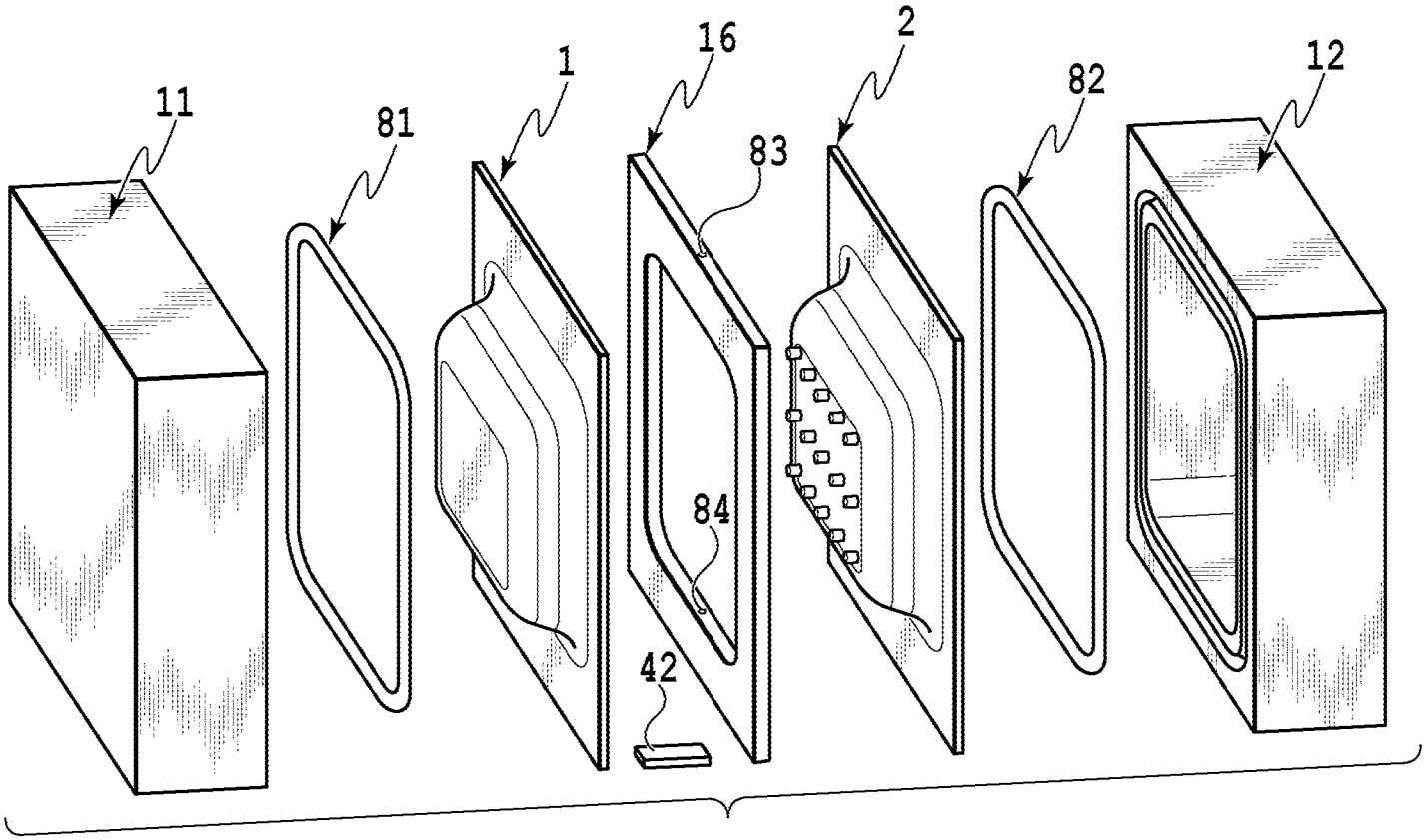
FIG. 4 is an exploded perspective view of an ejection-material storing unit in FIG. 1.

FIG. 4 is an exploded perspective view of the storing container 13. The interface between the first film 1 and the housing 11 is sealed by an O-ring 81, and the interface between the second film 2 and the housing 12 is likewise sealed by an O-ring 82. On the other hand, a spacer 16 is sandwiched between the first film 1 and the second film 2. Further, the two films 1 and 2 and the spacer 16 are brought into tight contact with each other between the housing 11 and the housing 12 by fastening fixing bolts not illustrated. As with the materials of the two films 1 and 2, the material of the spacer 16 is desirably PTFE. In this way, even if the film 1 is damaged and the ejection liquid flows out into an inter-film space 4 between the films 1 and 2, it is possible to avoid a situation where the ejection liquid contacts members other than the member with the same quality as the film 1. The two films 1 and 2 and the spacer 16 may be fixed by fusing or bonding to improve the degree of tightness of the contact between the two films 1 and 2 and the spacer 16. It is more desirable to mold the films 1 and 2 and the spacer 16 integrally with each other.

The spacer 16 is provided in its upper portion with an air suction port 83 communicating with the outside and is provided in its lower portion with a liquid discharge port 84 communicating with the outside. A liquid leakage sensor 42 to be described later is disposed under this liquid discharge port 84. As will be described later, if the film 1 or 2 is damaged and the liquid in the storing space 5 or 6 leaks out into the inter-film space 4, that liquid will be guided by the spacer 16 into the liquid discharge port 84, pass through the liquid discharge port 84, drip downward, and be detected by the liquid leakage sensor 42. Although an inner surface of the spacer 16 is simplified and illustrated as a flat surface in FIG. 4, the inner surface is desirably inclined toward the liquid discharge port 84.

Figure 5A:
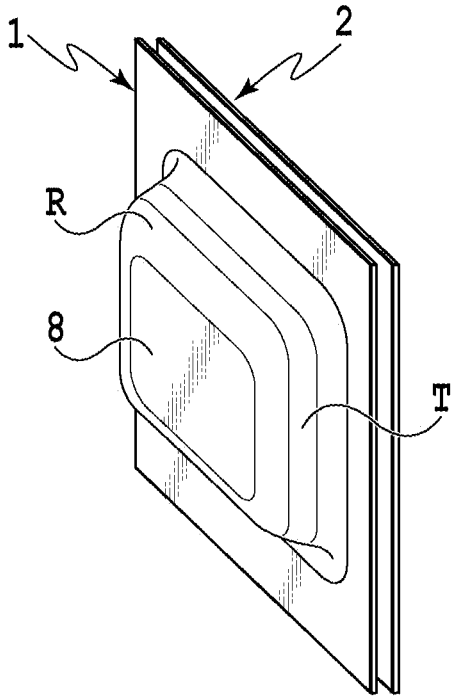
FIG. 5A is a perspective view of a first film and a second film in FIG. 4.
Figure 5B:
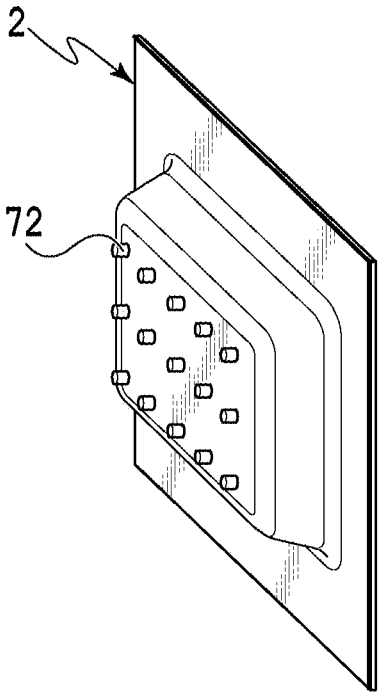
FIG. 5B is a perspective view of the second film in FIG. 4.

FIGS. 5A and 5B are explanatory views of the shapes of the two films 1 and 2, which constitute the flexible member. The films 1 and 2 are molded with a PTFE film in a protruding shape corresponding to the recessed shape of the inside of the housing 11. As illustrated in FIG. 5B, multiple protrusions 72 for linking coupling are formed on the second film 2. The films 1 and 2 are connected to each other by placing the films 1 and 2 one over the other as illustrated in FIG. 5A and irradiating the portions of the protrusions 72 of the second film and the first film 1 in contact with each other with laser light from a laser processing machine to thereby thermally fuse these contacting portions to each other. In this embodiment, the case where the protrusions 72 are provided to the second film 2 has been described. However, these protrusions 72 may not be provided. For example, the films 1 and 2 placed one over the other can be fused to each other along a fusing line or at multiple fusing points with a laser processing machine.

The protruding portion of the flexible member, including the two films 1 and 2, may be tapered. Providing a curved-shape portion (curved portion) R at each corner and edge of the protruding portion can further facilitate deformation of the flexible member. The inner surfaces of the first storing space 5 and the second storing space 6 may be shaped to extend along such a shape of the flexible member.

The first film 1 and the second film 2 need to move smoothly as a single body as the ejection material is ejected. For this reason, the areal density (amount (quantity, area) per unit area) of the linking portions 3 between them is preferably higher at a center region 8 surrounded by a tapered-shape portion (tapered portion) T and the curved portions R than at the tapered portion T and the curved portions R. The center region 8 is a region that directly receives pressure that causes the films to move together, and is therefore preferably flat. However, the center region 8 may not be strictly flat but may be gently curved, for example. Also, among the tapered portion T, the curved portions R, and the center region 8, the areal density of linking portions 3 is preferably lowest at the curved portions R since the higher the areal density of linking portions 3, the higher the stiffness.

Figure 6:
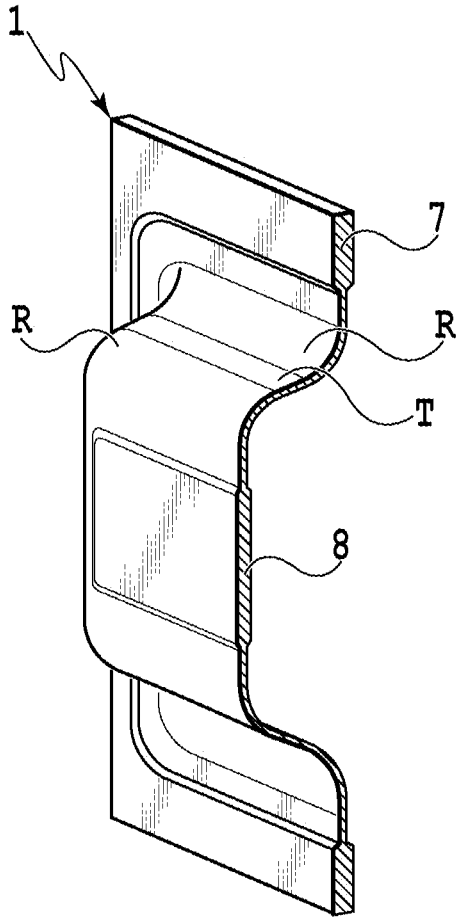
FIG. 6 is a cross-sectional view of the first film in FIG. 4.

A soft material or a thin material may be used for at least one of the first film and the second film to lower the stiffness of the flexible member as a whole so that the first film and the second film can be moved smoothly as a single body. As for the shape of each film itself, the thickness may be varied in some parts as illustrated in FIG. 6, for example, so that the strength can be different in some parts. For example, to facilitate deformation of the film, the thickness of the curved portions R and the tapered portion T may be smaller and the thickness of the center region 8 and an outer edge portion 7, which are not desired to be deformed, may be larger.

As illustrated in FIG. 1, the space between the two films 1 and 2 of the flexible member communicates with the outside air (atmosphere) through the air suction port 83 and the liquid discharge port 84. On the other hand, the internal pressures of the first storing space 5 and the second storing space 6 are controlled to maintain the same negative-pressure state relative to the outside air pressure (atmospheric pressure). For this reason, the non-connected regions of the films 1 and 2, which are their portions not fused to each other, are pulled toward the first storing space 5 and the second storing space 6 which the respective films cover, so that an expanded space 4 is formed between the films 1 and 2. Hereinafter, the space 4 between the first film 1 and the second film 2 will also be referred to as the inter-film space.

Figure 7:
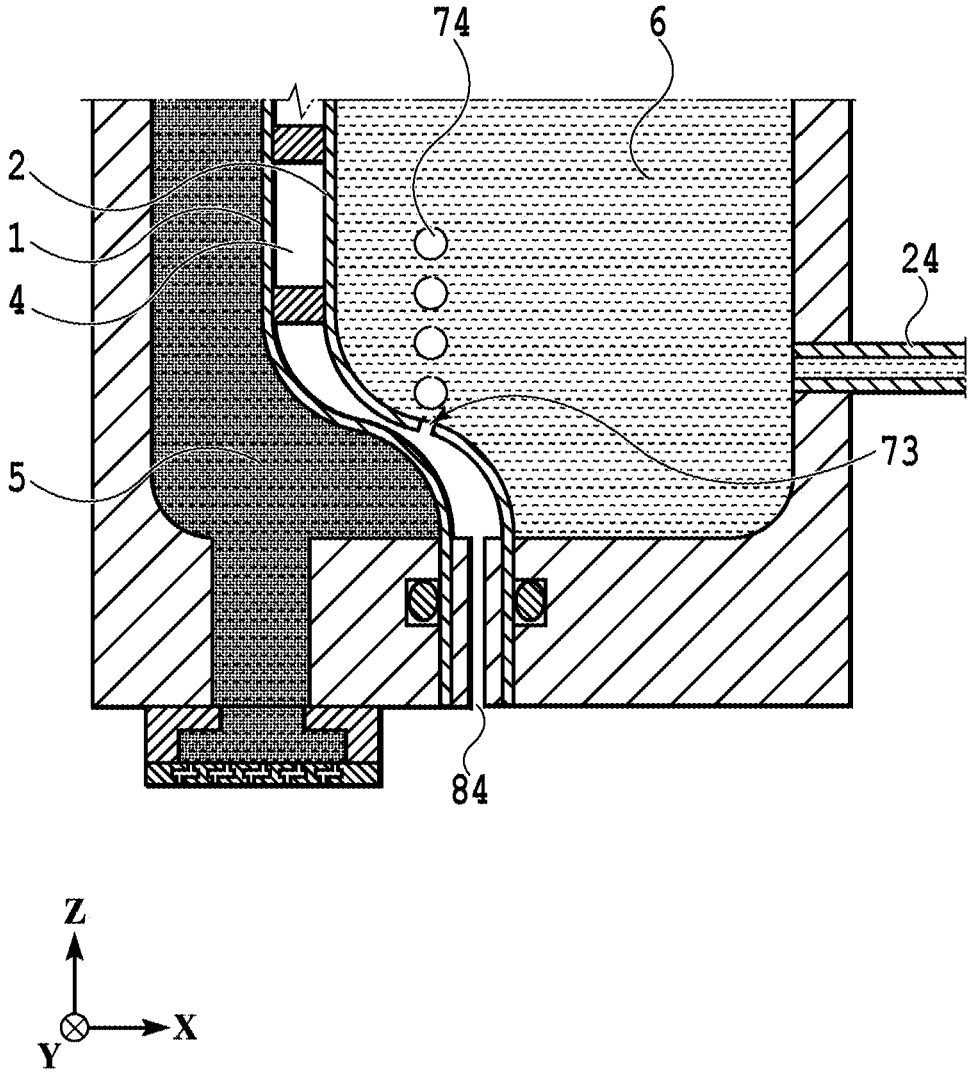
FIG. 7 is an explanatory diagram of a state where one of the films has been damaged.

FIG. 7 is an explanatory diagram of a state and behavior of the ejection apparatus in this embodiment in a situation where part of the second film 2 has been damaged. Since the inter-film space 4 between the first film 1 and the second film 2 in this embodiment is an open space communicating with the atmosphere, the internal pressure of the inter-film space 4 is equal to the atmospheric pressure. On the other hand, the first storing space 5 and the second storing space 6 are both adjusted to be at a negative pressure lower than the atmospheric pressure by 0.4±0.04 kPa, as mentioned earlier. As illustrated in FIG. 7, if part of the second film 2 is damaged and a hole 73 is formed therein, air will be sucked from the inter-film space 4 on the higher pressure side into the second storing space 6 on the lower pressure side through that hole 73 in the form of air bubbles 74. The internal pressure of the air bubbles 74 is equal to the atmospheric pressure. Thus, the air bubbles 74 raise the internal pressure of the second storing space 6 and push the operating liquid inside the second storing space 6 toward the sub tank 26 through the tube 24.

The operating liquid thus pushed out of the second storing space 6 raises the liquid level of the operating liquid inside the sub tank 26. By detecting this rise in liquid level with the liquid level sensor 41 (see FIG. 1), it is possible to detect that the film has been damaged and air bubbles have entered the storing space. The 'film' mentioned here collectively represents the first film 1 and the second film 2, and the 'storing space' collectively represents the first storing space 5 and the second storing space 6. The terms 'film' and 'storing space' may be used similarly in the following part of this description.

A case where the height of the liquid level of the operating liquid 35 inside the sub tank 26 changes due to different reasons other than film damage will now be considered.

First, as mentioned earlier, when the operating liquid 35 in the sub tank 26 is replenished from the main tank 34 in order to maintain the value of the height difference Δ H, illustrated in FIG. 1, within the predetermined range, the liquid level of the operating liquid 35 inside the sub tank 26 rises, as a matter of course. In this case, the amount of liquid sent is known. Thus, it is possible to distinguish between the change in height of the liquid level due to replenishment of the operating liquid and unexpected and abnormal change in height of the liquid level. Also, when the ejection material is ejected from the ejection ports 15, the operating liquid is supplied in the amount of this ejection from the sub tank 26 to the second storing space 6. As a result, the height of the liquid level of the operating liquid inside the sub tank 26 changes and, in this case, the liquid level changes in the downward direction. Thus, it is possible to clearly distinguish between the downward change in height of the liquid level due to ejection of the ejection material and the upward change in height of the liquid level due to film damage.

As described above, if part of the second film 2 is damaged, it is possible to detect the occurrence of the film damage by detecting the consequential rise in liquid level of the operating liquid 35 inside the sub tank 26 with the liquid level sensor 41.

Also, in FIG. 1, the tube 24, through which the second storing space 6 and the inside of the sub tank 26 communicate with each other, is equipped with a flow speed sensor 77. If the first film 1 or the second film 2 is damaged, the operating liquid 35 inside the second storing space 6 will be pushed out into the sub tank 26 through the tube 24. The flow speed of the operating liquid thus pushed out can be detected with the flow speed sensor 77. On the other hand, when the ejection material is ejected from the ejection ports 15, the operating liquid inside the sub tank 26 is supplied in the amount of this ejection to the second storing space 6 through the tube 24. The direction of flow of the operating liquid thus supplied is opposite from the direction of flow of the operating fluid upon occurrence of film damage. Thus, it is possible to clearly distinguish between the flow of the operating liquid due to ejection of the ejection material and the flow of the operating liquid due to film damage.

Next, a case where part of the first film 1 is damaged will be described. The state and behavior of the ejection apparatus in this case are similar to those in the case where part of the second film 2 is damaged. Specifically, if part of the first film 1 is damaged, air bubbles 74 will be sucked into the first storing space 5 through the damaged spot. The pressure in the air bubbles 74 is equal to the atmospheric pressure. Thus, the air bubbles 74 raise the internal pressure of the first storing space 5 and accordingly makes this internal pressure higher than the internal pressure of the second storing space 6. As a result, the first film 1 and the second film 2, each functioning as a barrier, move as a single body toward the second storing space 6 and thereby push out the operating liquid 35 inside the second storing space 6 into the sub tank 26. The operating liquid thus pushed out raises the liquid level of the operating liquid inside the sub tank 26, and the liquid level sensor 41 detects this rise (see FIG. 1). Since an unexpected and abnormal height of liquid level is detected, it is possible to detect that film damage has occurred and air bubbles 74 have entered the corresponding storing space.

As described above, regardless of which is damaged, the first film 1 or the second film 2, it is possible to detect that one of the films has been damaged by using the liquid level sensor 41 and the flow speed sensor 77 together with the later-described liquid leakage sensor 42. Also, regardless of which is damaged, the first film 1 or the second film 2, the ejection material and the operating liquid will remain separated from each other and will never contact each other.

Also, if film damage occurs, the internal pressure of the first storing space 5 can rise until becoming equal to the outside air pressure. This leads to a possibility that the ejection material fails to maintain the state of forming the meniscus 17 and drip out of the ejection port 15 at an unintended time. However, the ejection apparatus in this embodiment can detect abnormality at the point when the internal pressure of the first storing space 5 turns to rise. Then, by issuing an abnormality alarm based on that detection, it is possible to implement dripping prevention before the ejection material drips. Examples of the dripping prevention include capping the ejection ports, controlling the negative pressure in the second storing space by using a pressure controller, and so on.

In this embodiment, the inter-film space 4 between the first film 1 and the second film 2 communicates with the outside air and is therefore at the equal pressure to the atmospheric pressure. However, the pressure difference between the inter-film space 4 and the storing spaces 5 and 6 can be maintained also by providing a valve for controlling the communication between the inter-film space 4 and the outside air, adjusting the air pressure inside the inter-film space 4 to the atmospheric pressure in advance with the outside air, and then closing the valve to make the inter-film space 4 a sealed space. If the first film 1 or the second film 2 is damaged in this state, the gas inside the inter-film space 4 will flow into the first storing space 5 or the second storing space 6. In this case, the amount of inflow of the gas is at most the capacity of the space between the first film 1 and the second film 2. Thus, it is possible to prevent dripping of the ejection material from the ejection ports by detecting film damage with a significantly small amount of inflow of the gas as compared to the case where the inter-film space 4 communicates with the outside air.

Film damage occurs due to various reasons. For example, in a printing apparatus using ink as the ejection material, its films serving as barriers may possibly get a hole due to manufacturing variations. Also, the films serving as barriers may possibly get a hole due to their repetitive movement and deformation inside the storing container 13. Also, many problems occur with a configuration in which the operating liquid gets mixed into the ejection material as soon as the films get a hole, as in the conventional example discussed in PTL 1. Specifically, if water serving as the operating liquid gets mixed and diffused in ink for printing images, the ink is diluted by the water and printed images will be dimmer. Also, since the operating liquid contains an additive, which is an impurity, a deposit in the operating liquid or particles in the operating liquid may possibly clog the ejection ports 15 measuring about 10 μm in diameter and lead to a condition where the ejection material cannot be ejected. Thus, in a situation where the films serving as barriers get a hole, it is extremely important to prevent contact between or mixing of the ejection material and the operating liquid.

In a case where the ejection apparatus in this embodiment is employed as a photosensitive-resist coating apparatus for a semiconductor exposure apparatus, the advantageous effect achieved by preventing contact between the ejection material and the operating liquid is greater. In photosensitive-resist coating apparatuses, the density of ejection patterns is so low that the diameter of the ejection ports 15 is about 10 μm, as with high-density printing apparatuses. For this reason, clogging by impurities is a serious problem. Further, the photosensitive resist is required to satisfy an essential requirement that the concentration of ions of metals such as Na and Mg dissolved in the resist is less than several ppb. Even if the photosensitive resist and the operating liquid do not get mixed with each other, only contact between them allows metal ions in the operating liquid to move into the photosensitive resist and causes metal ion contamination. In addition, if the photosensitive resist with the metal ion contamination is applied to a wafer, the metal ion contamination spreads to all production apparatuses at the next and subsequent stages that contact this wafer, which is a serious problem. Thus, it is extremely important to be able to detect the occurrence of film damage without the ejection material and the operating liquid contacting each other.

Also, based on the height of the liquid level measured by the liquid level sensor 41, the control apparatus (the CPU 202 in FIG. 2) calculates two types of values, namely, the amount of change in the position of the liquid level and the rate of change in the position of the liquid level per given time interval (hereinafter, also referred to as "liquid-level change speed"). The liquid level of the operating liquid 35 inside the sub tank 26 sometimes changes abruptly due to a vibration such as an earthquake, for example. However, when the liquid level changes due to an earthquake, the liquid-level change speed is detected to switch between positive and negative values. In contrast, when the liquid level of the operating liquid inside the sub tank 26 rises due to film damage as described earlier, the liquid-level change speed is detected only in the positive direction. Thus, the control apparatus can recognize and distinguish between the change in liquid level due to a vibration such as an earthquake and the change in liquid level due to film damage based on how the liquid-level change speed changes.

Meanwhile, the operating liquid 35 is supplied from the main tank 34 to the sub tank 26 to maintain the value of the height difference Δ H within a certain range, as described earlier. For this supply operation, the amount of the liquid to be sent is already known, as described earlier, and also the liquid-level change speed is calculated by the control apparatus. If film damage occurs while the operating liquid 35 is being sent, the liquid-level change speed will be detected to be higher than the known value. This makes it possible to recognize an abnormal state resulting from the film damage.

Also, when the height difference Δ H is corrected, it is also possible to calculate the cumulative value of the amount of the operating liquid supplied from the main tank 34 to the sub tank 26 for replenishment. The cumulative value of the amount of the operating liquid supplied for replenishment is equal to the amount of decrease of the ejection material inside the first storing space 5. Thus, it is possible to simultaneously figure out the total amount of the ejection material ejected and the amount of the ejection material remaining inside the first storing space 5. This function makes it possible to figure out the relation between the duration of use of the storing container 13 and the amount of the remaining liquid and calculate a predicted remaining life.

Figure 8:
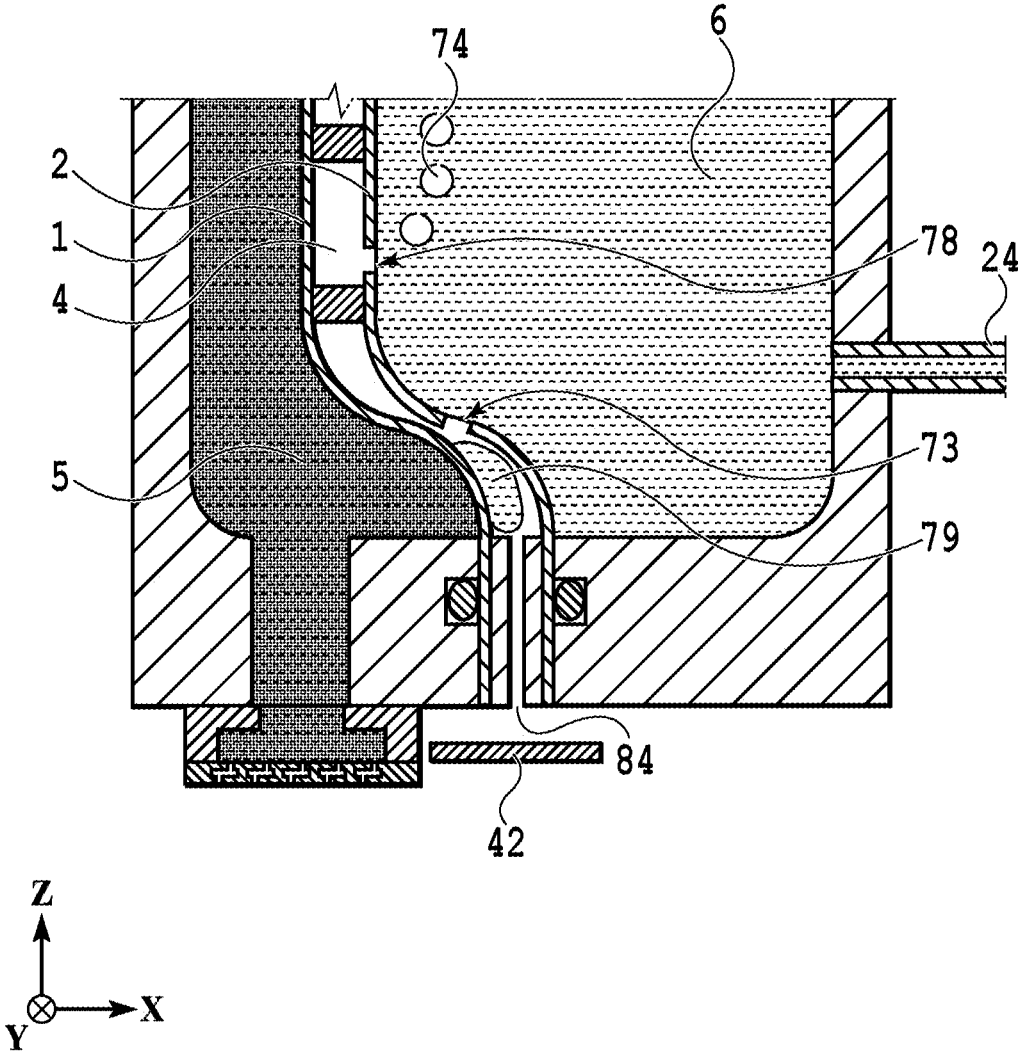
FIG. 8 is an explanatory diagram of a state where one of the films has been damaged.

As described above, if either film is damaged and a hole 73 is formed therein, air bubbles 74 will be sucked into the storing space 5 or 6, so that the internal pressure of that storing space becomes closer to the outside air pressure. Also, it is possible that the film is damaged to such a great extent that a hole 78 with a diameter of approximately 200 μm or larger is formed, as illustrated in FIG. 8, or that multiple holes 73 are formed simultaneously. If holes 73 and 78 are formed in the second film 2 as illustrated in FIG. 8, air bubbles 74 will be sucked into the second storing space 6 from the hole 78 while at the same time the operating liquid will leak out into the inter-film space 4 from the hole 73 as leaking liquid 79. Depending on the tube resistance of the tube 24 between the second storing space 6 and the sub tank 26, the operating liquid leaks to the outside from the liquid discharge port 84 as leaking liquid 79 before the operating liquid is pushed back into the sub tank 26. Then, by dripping onto the liquid leakage sensor 42, the leaking liquid 79 is detected. Likewise, if holes 73 and 78 are formed in the first film 1, air bubbles 74 will be sucked into the first storing space 5 from the hole 78 while at the same time the ejection liquid will leak out into the inter-film space 4 from the hole 73 as leaking liquid 79. This leaking liquid 79 is then detected by the liquid leakage sensor 42.

Also, for a liquid ejection apparatus using photosensitive resist as its ejection liquid and using water with a preservative mixed therein as its operating liquid, it is possible to determine whether leaking liquid is the ejection liquid or the operating liquid by using an optical liquid leakage sensor as the liquid leakage sensor 42. In this case, the optical liquid leakage sensor has sensitivity individually to the ejection liquid and the operating liquid. However, in the case of using a conduction-short circuit detection-type leakage sensor is used, the sensor may have sensitivity to the photosensitive resist but not to the water or have sensitivity to the water but not to the photosensitive resist, depending on the type. These cases can be handled by using multiple types of leakage sensors. Specifically, by using a leakage sensor including a detection unit that detects the photosensitive resist and a detection unit that detects the water, it is possible to detect film damage while distinguishing whether it is damage of the film 1 or of the film 2.

As described above, in this embodiment, the detection of film damage with the liquid level sensor 41 and the flow speed sensor 77 and the detection of film damage with the liquid leakage sensor 42 can be carried out in parallel. Thus, film damage can be detected and handled quickly and certainly regardless of the extent of the film damage. In particular, since the liquid leakage sensor 42 can directly detect leaking liquid, film breakage (damage) can be detected more certainly. Also, film breakage (damage) can be detected only with this liquid leakage sensor 42 as well.

Second Embodiment

Figure 9:
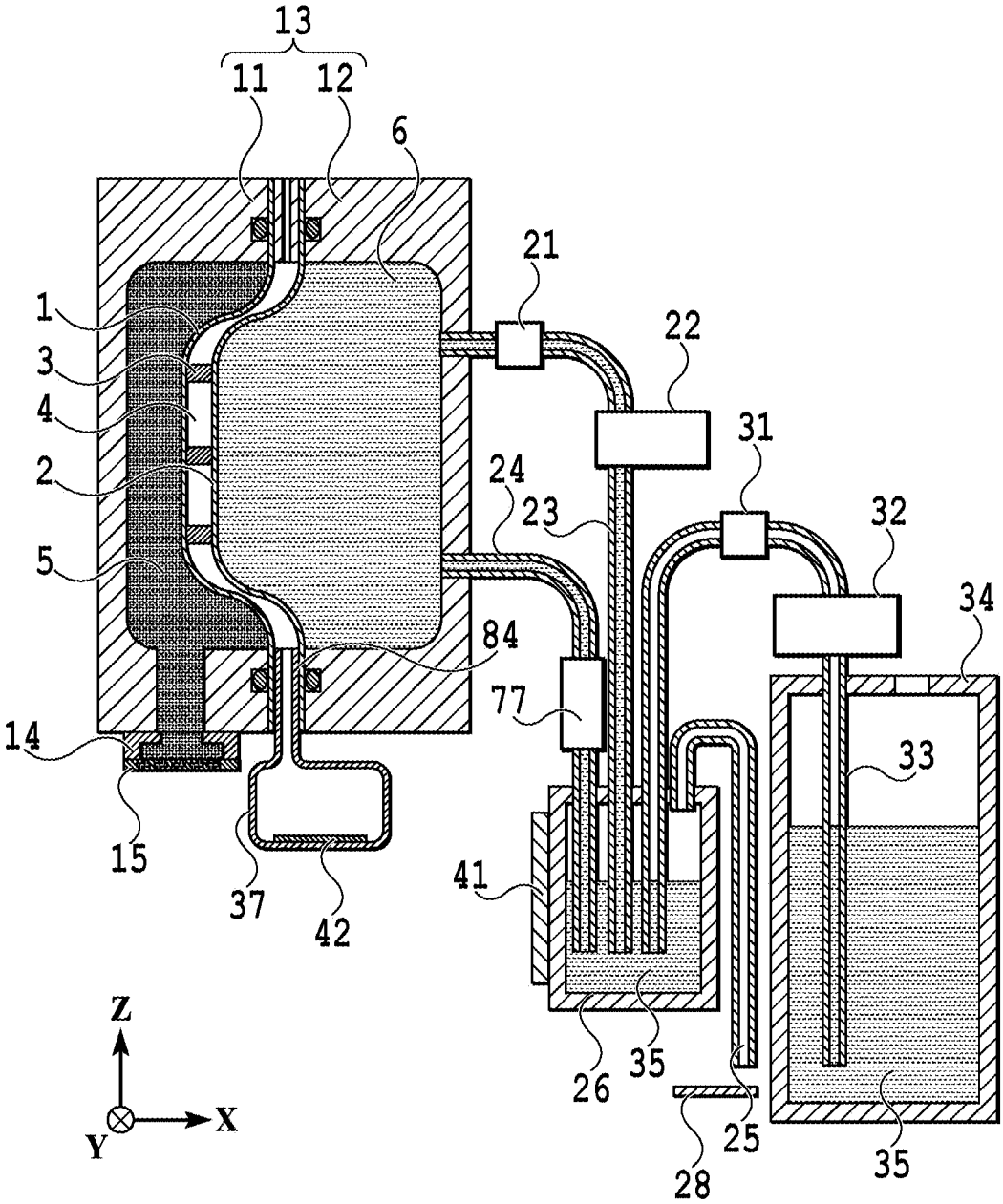
FIG. 9 is a configuration diagram of an ejection apparatus in a second embodiment of the present invention.

FIG. 9 is an explanatory diagram of a second embodiment of the present invention, which differs from the above first embodiment in how the liquid leakage sensor 42 is arranged.

In FIG. 9, a sealed leaking liquid tank (leaking-liquid storing unit) 37 is connected under a liquid discharge port 84, and a liquid leakage sensor 42 is disposed at the bottom by this leaking liquid tank 37. The leaking liquid tank 37 prevents leaking liquid discharged from the liquid discharge port 84 from being spread to the outside. The fluid leaking out from the liquid discharge port 84 is detected by the liquid leakage sensor 42 without being spread to the outside. In the case of using photosensitive resist is used as the ejection liquid, it is possible also to prevent collateral damage by spread of the ejection liquid and the gas formed by its vaporization while maintaining the leaking-liquid detecting function with the liquid leakage sensor. Also, a liquid leakage sensor 28 is installed under a tube 25 for detecting the operating liquid dripping from the tube 25. If the operating liquid is returned into a sub tank 26 from inside a second storing space 6 due to film breakage (damage) and the operating liquid overflows from the sub tank 26, the overflowing operating liquid can be detected with the liquid leakage sensor 28.

Third Embodiment

Figure 10:
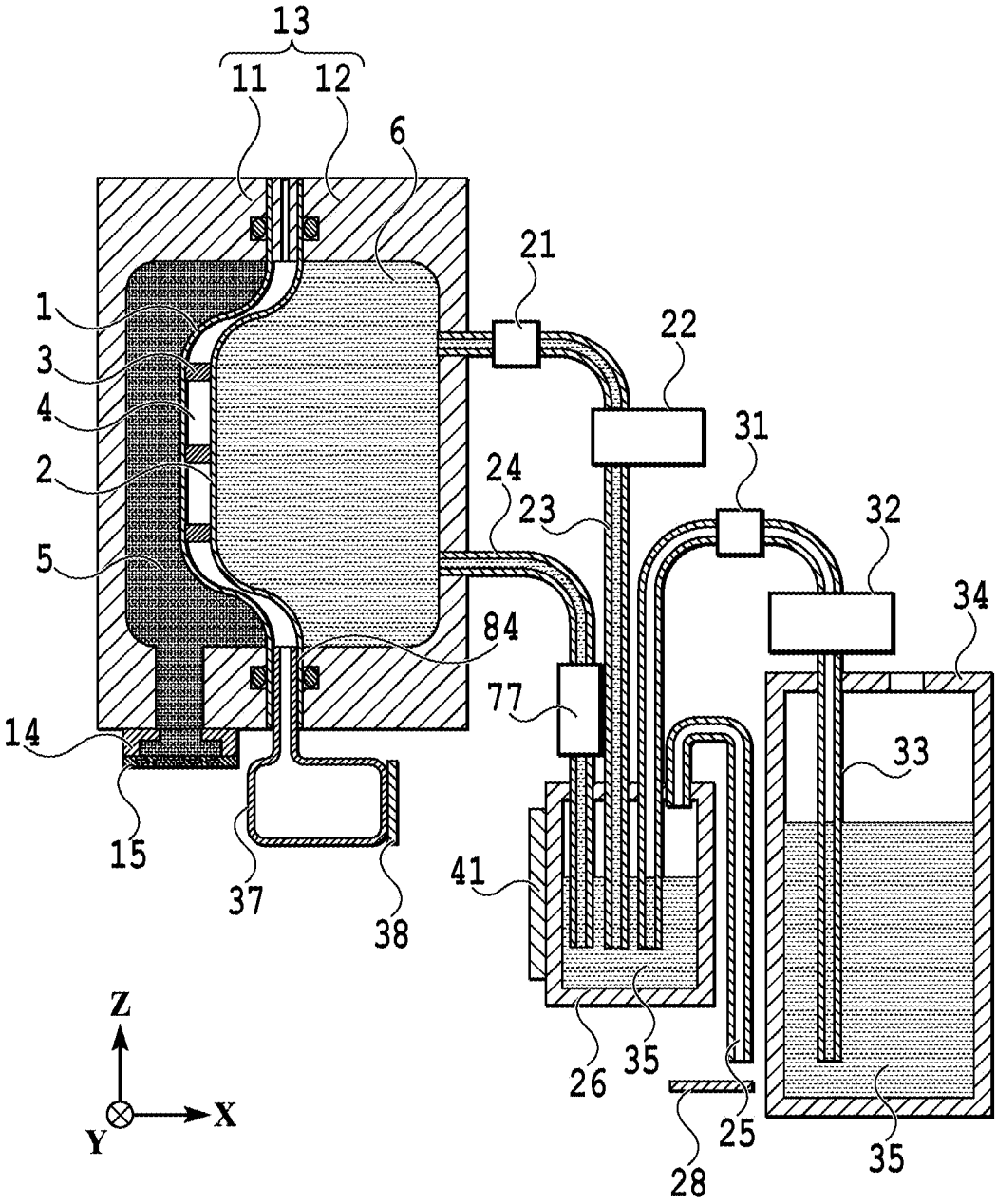
FIG. 10 is a configuration diagram of an ejection apparatus in a third embodiment of the present invention.

FIG. 10 is a diagram for explaining a third embodiment of the present invention, in which a liquid leakage sensor 42 is not disposed in a leaking liquid tank 37 but a liquid level sensor 38 is instead disposed on the side surface of the leaking liquid tank 37. The liquid level sensor 38 detects the liquid level of leaking liquid inside the leaking liquid tank 37, regardless of whether the leaking liquid is the ejection liquid or the operating liquid. Also, since the liquid level sensor 38 does not contact the leaking liquid, the liquid level sensor 38 will not be contaminated. In the case of using a contact-type liquid leakage sensor that contacts the leaking liquid, it is difficult to remove and clean the leaking liquid attached to the liquid leakage sensor when bringing the liquid ejection apparatus back into operation after detecting the leaking liquid. In the case of using the non-contact-type liquid level sensor 38, which does not contact the leaking liquid, as in this embodiment, it is not necessary to perform the work of removing and cleaning the leaking liquid when the liquid ejection apparatus is brought back into operation. This facilitates the maintenance. Further, in this embodiment, if liquid leakage occurs inside the storing container 13 due to film damage, the liquid ejection apparatus can be brought back into operation by replacing the leaking liquid tank 37 together with the storing container 13.

Also, a capacitive detection method or an optical method can be employed as the method of detecting the liquid level of the leaking liquid inside the leaking liquid tank 37 with the liquid level sensor 38. In the case of using an optical liquid level sensor, at least part of the leaking liquid tank is made of a transparent material, and the liquid level is detected through this transparent part. In this case, it is also possible to determine which has been damaged, the film 1 or the film 2, by further disposing a sensor that determines the type of leaking liquid based on the color or refractive index of the leaking liquid, as in the conventional example discussed in PTL 2.

Fourth Embodiment

Figure 11:
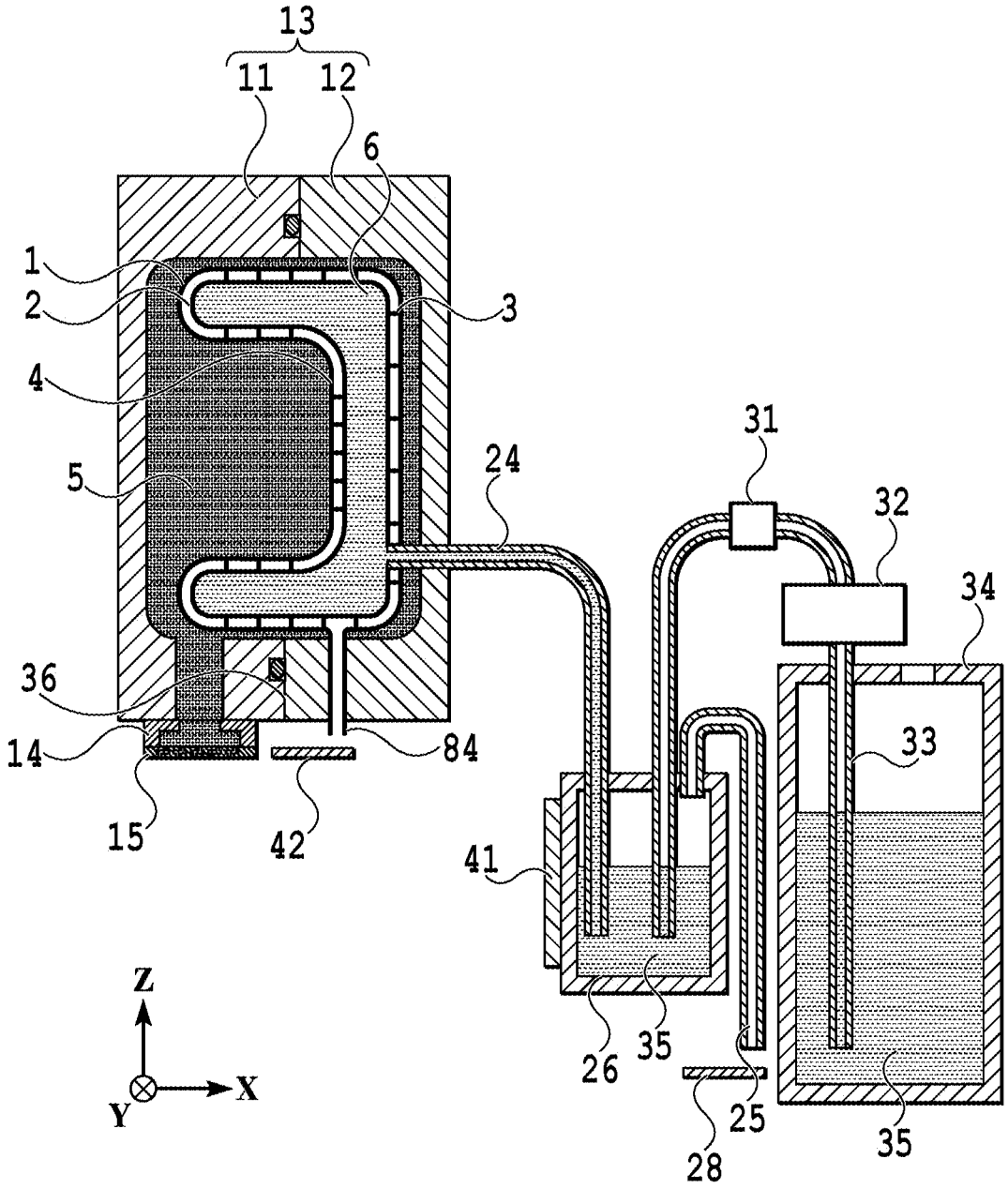
FIG. 11 is a configuration diagram of an ejection apparatus in a fourth embodiment of the present invention.

FIG. 11 is an explanatory diagram of a fourth embodiment of the present invention, in which two layers of films 1 and 2 forming a bag is inserted in a storing container 13, and the outside of the bag is defined as a first storing space 5 for the ejection liquid while the inside of the bag is defined as a second storing space 6 for the operating liquid to thereby separate these storing spaces 5 and 6 from each other. In this embodiment, a liquid leakage sensor 42 is disposed under a liquid discharge port 84 on the lower side communicating with an inter-film space 4 between the films 1 and 2. Even if the film 1 or 2 is damaged, the leaking liquid leaking out from the damaged spot is guided to and detected by the liquid leakage sensor 42. A leaking liquid tank 37 may be connected to the liquid discharge port 84, as in the above second third embodiments.

The exit of the liquid discharge port 84 may be shaped to open at the outer lower surface (flat surface) of the storing container 13, as illustrated in FIG. 1. With the exit of the liquid discharge port 84 thus shaped, the surface tension of the leaking liquid inside the inter-film space 4 may possibly make it easier for the leaking liquid to spread horizontally on the outer wall surface of the housing 12 at which the liquid discharge port 84 opens. If so, it is harder for the leaking liquid to drip onto the liquid leakage sensor 42. In such a case, it is desirable to attach a cylindrical protrusion to the exit of the liquid discharge port 84, as illustrated in FIG. 11.

Fifth Embodiment

Figure 12:
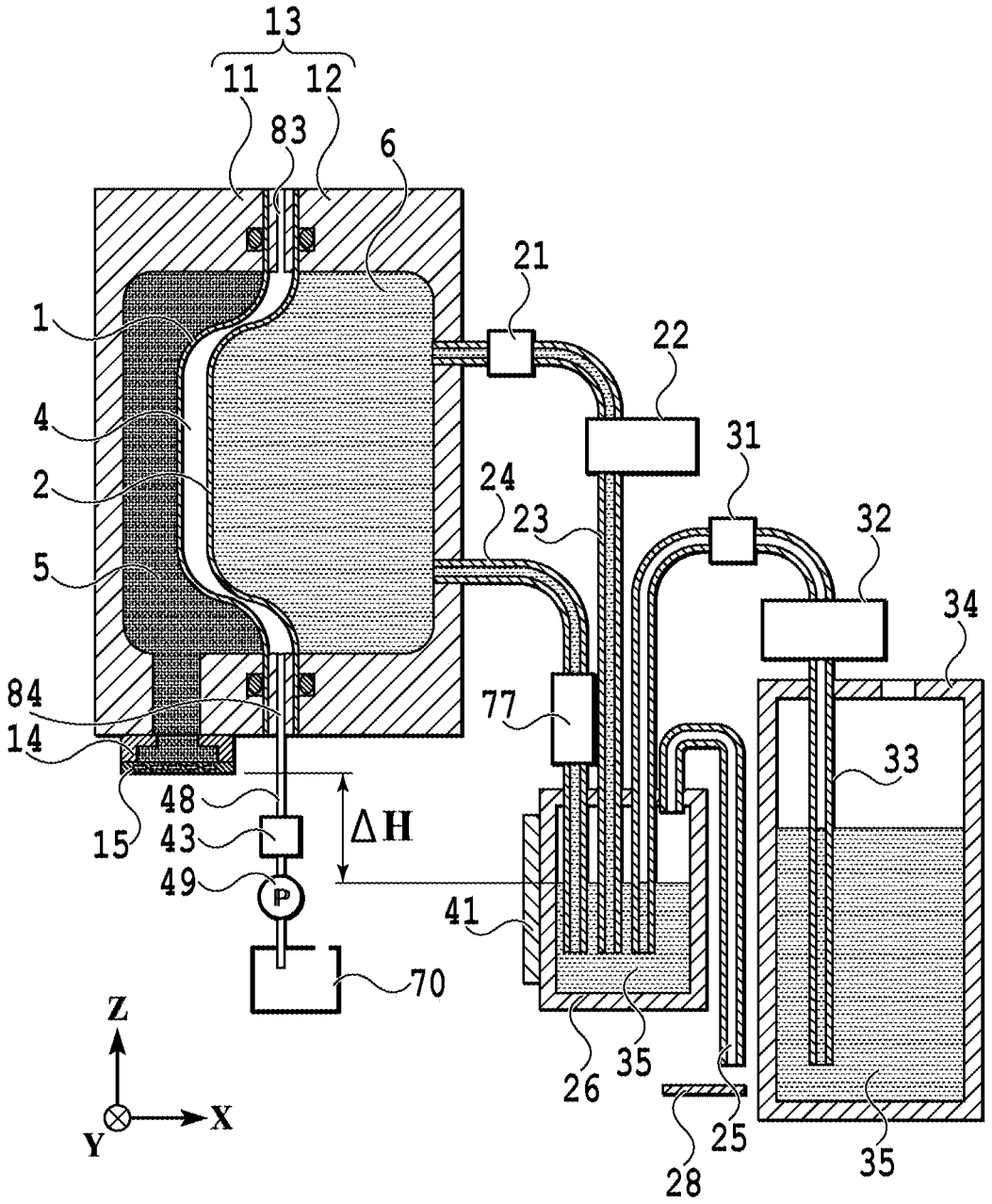
FIG. 12 is a configuration diagram of an ejection apparatus in a fifth embodiment of the present invention.

FIG. 12 is a diagram for explaining a fifth embodiment of the present invention, in which a discharge tube 48 is connected to a liquid discharge port 84. A liquid leakage sensor 43 and a discharge pump 49 are connected to the discharge tube 48, and the lower end of the discharge tube 48 is connected to a waste-liquid container 70. As in the above embodiments, films 1 and 2 are partly connected to each other by fusing or the like, and the films 1 and 2 move as a single body to maintain the internal pressures of storing spaces 5 and 6 at equal pressure.

The discharge pump 49, provided for the liquid discharge port 84, sucks the outside air from an air suction port 83 through an inter-film space 4. In this way, leaking liquid (operating liquid or ejection liquid) having leaked out into the inter-film space 4 is sucked and discharged through the discharge tube 48 and quickly reaches and is certainly detected by the liquid leakage sensor 43. The films 1 and 2 do not need to be connected to each other by fusing or the like if the discharge pump 49 and a choke or the like not illustrated can maintain the inside of the inter-film space 4 in a negative-pressure state and bring the films 1 and 2 into tight contact with each other at least partly such that they can move as a single body. The discharge pump 49 does not need to be operated constantly but may be intermittently driven at regular time intervals. The liquid leakage sensor 43 may be configured to detect the operating liquid and the ejection liquid without distinguishing one from the other or may be configured to be capable of detecting them while distinguishing one from the other.

Sixth Embodiment

Figure 13:
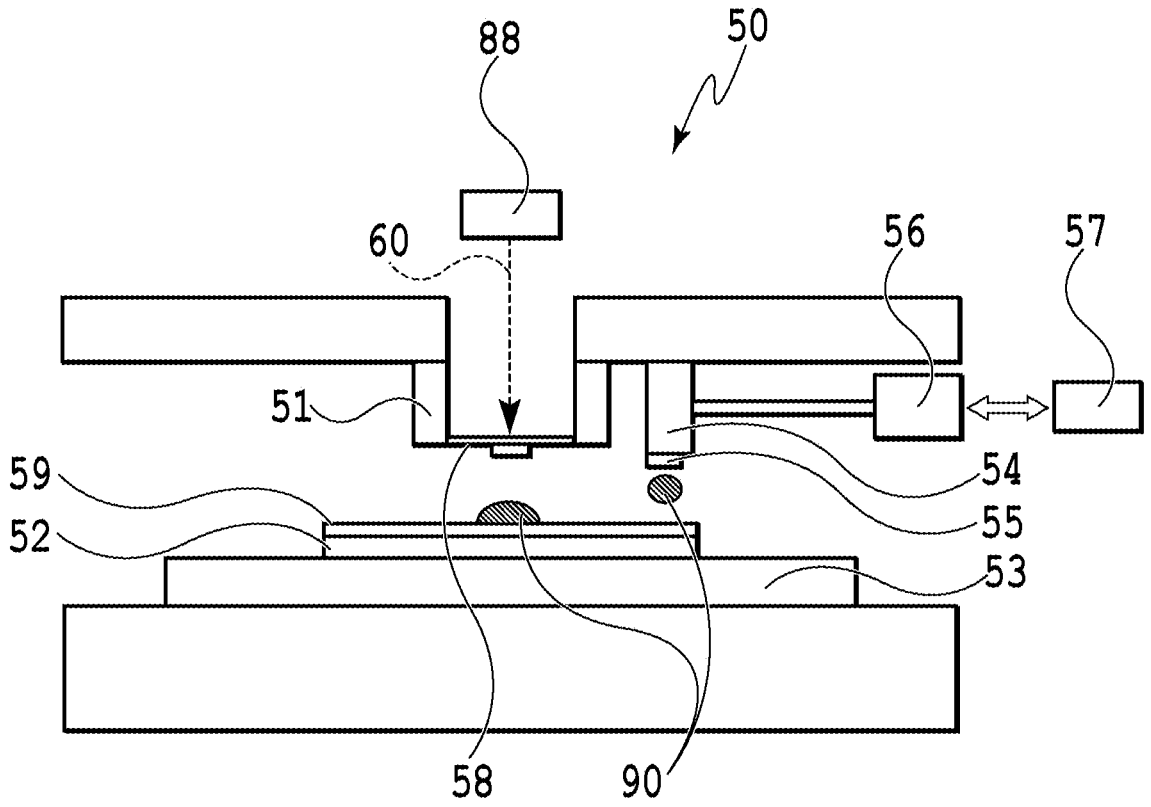
FIG. 13 is a configuration diagram of an imprinting apparatus in a sixth embodiment of the present invention.

FIG. 13 is a schematic configuration diagram of a liquid ejection apparatus in a sixth embodiment. The liquid ejection apparatus in this embodiment represents an example in which it is employed in an imprinting apparatus 50.

Imprinting apparatuses are used to manufacture products as typified by semiconductor devices. The imprinting apparatus 50 presses a mold 58 having a molding pattern against uncured resin (resist) 90 applied to a shot region on a substrate 59 and, in this state, irradiates the resin 90 with light 60 (e.g. ultraviolet rays) to cure the resin 90. Thereafter, the imprinting apparatus 50 separates the mold 58 from the cured resin 90. As a result, the pattern on the mold 58 is transferred to the substrate 59. The imprinting apparatus 50 in this embodiment is an imprinting apparatus employing an optical imprinting method and includes a light irradiation unit 88, a mold hold unit 51, a substrate chuck 52, a substrate stage 53, an ejection-liquid ejection apparatus 54, an ejection head 55, a pressure control unit 56, and a control unit 57.

In imprinting, the light irradiation unit 88 irradiates the resin 90 with applies the light 60 through the mold 58. The wavelength of the light 60 is a wavelength suitable for the resin 90 to be cured. The pattern to be transferred, such as a circuit pattern, is formed on the surface of the mold 58 that faces the substrate 59. Quartz or the like that can transmit the light 60 can be used as the material of the mold 58. The mold hold unit 51 includes a mold chuck not illustrated that holds the mold 58, a mold drive mechanism not illustrated that holds this mold chuck movably, and a magnification correction mechanism not illustrated that corrects the shape of the mold 58. The substrate 59 is a silicon wafer, a silicon on insulator (SOI) substrate, a glass substrate, or the like.

On the substrate 59, there are multiple shots as pattern formation regions arranged in a particular shot layout. Each shot is formed on the substrate 59 immediately before imprinting by ejecting the resin 90 stored in the ejection apparatus 54 from the ejection ports of the ejection head 55. The pattern formed on the mold 58 is then impressed into the shot. As a result, a pattern of the resin 90 is formed on the substrate 59. The substrate chuck 52 holds the substrate 59, and the substrate stage 53 holds the substrate chuck 52 movably along with the substrate 59. The substrate stage 53 positions the mold 58 and the substrate 59 with respect to each other after the ejection head 55 applies the resin 90. The imprinting is performed in conjunction with this positioning.

In this series of imprinting actions, movement of the substrate 59 to a shot position, ejection and application of the resin 90, impressing, positioning, curing of the resin 90, releasing of the mold, and movement of the substrate 59 to the next shot position are performed sequentially, and this series of actions is repeated as needed.

Figure 14:
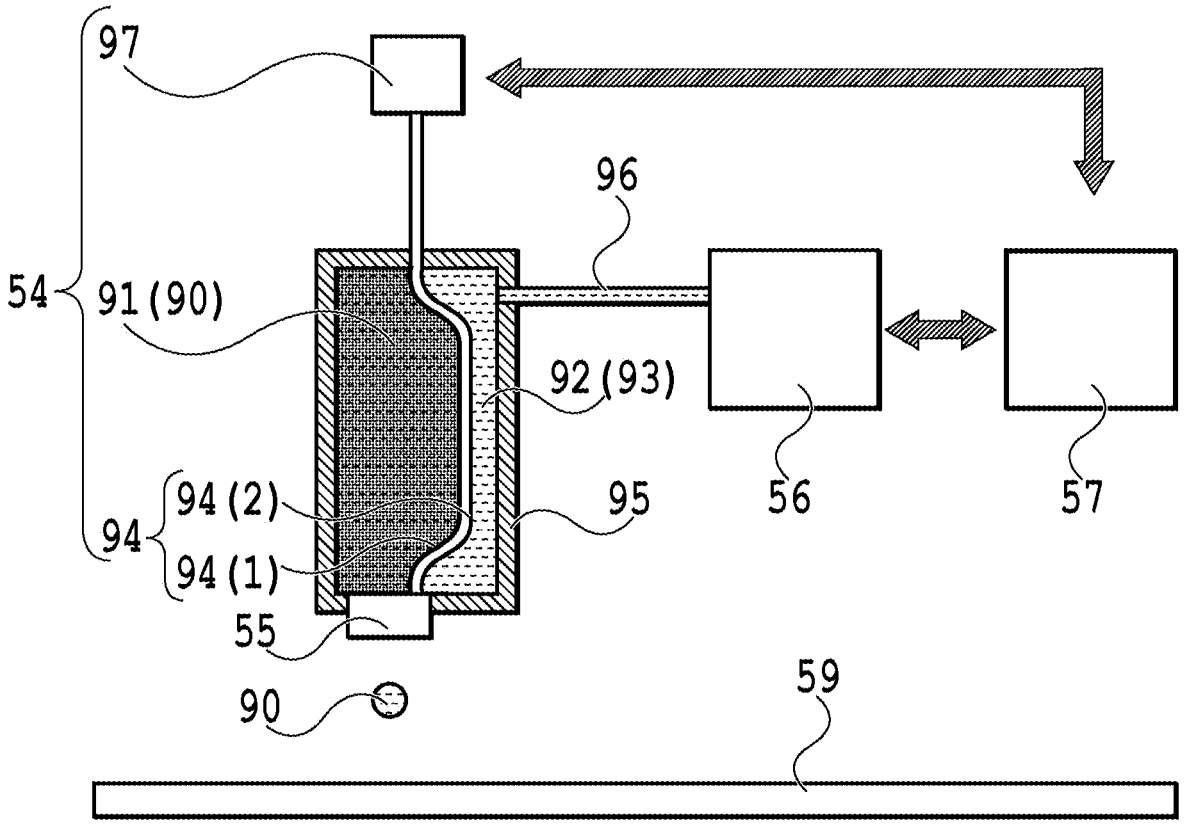
FIG. 14 is a configuration diagram of an ejection apparatus in FIG. 13.

FIG. 14 is a schematic configuration diagram of the ejection apparatus 54 in this embodiment.

The ejection apparatus 54 in this embodiment includes the ejection head 55, a storing container 95, the pressure control unit 56, the control unit 57, and a pressure measurement unit 97. The storing container 95 includes a flexible membrane 94 that separates the inside of the storing container 95 into a first storing space 91 and a second storing space 92. The first storing space 91, which communicates with the ejection head 55, is filled with the resin 90 (ejection material). The control unit 57 controls the ejection head 55 to eject the resin 90 from the ejection ports of the ejection head 55. In the ejection head 55, an actuator is installed in each of pressure chambers provided individually for the ejection ports. The actuator may only need to be an element capable of generating energy with which the resin 90 as the ejection material can be ejected in a fine droplet, e.g. a droplet of 1 pL. Specific examples include a piezoelectric element, a heat element, and so on. The ejection head 55 may not be integrated with the storing container 95 but may be replaceably mounted to the storing container 95. The second storing space 92, which does not communicate with the ejection head 55, is filled with an operating liquid 93. Cooling water or the like used in conventional exposure apparatuses is usable as the operating liquid 93. For example, a liquid obtained by adding preservative, humectant, etc. to water is usable as the operating liquid 93. The second storing space 92 communicates with the pressure control unit 56, which supplies the operating liquid 93, through a communicating member 96.

Figure 15A:
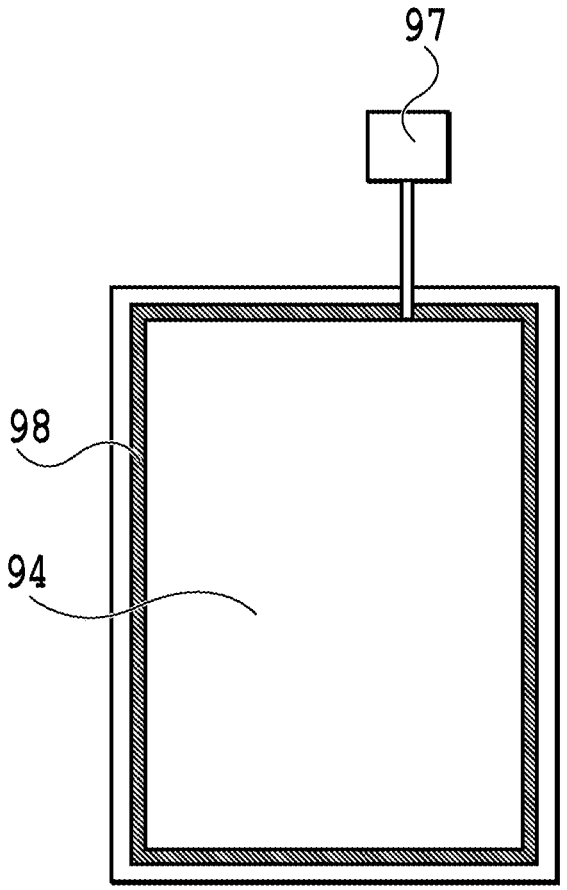
FIG. 15A is a configuration diagram of a sealing portion of first and second films constituting the flexible membrane in FIG. 14.
Figure 15B:
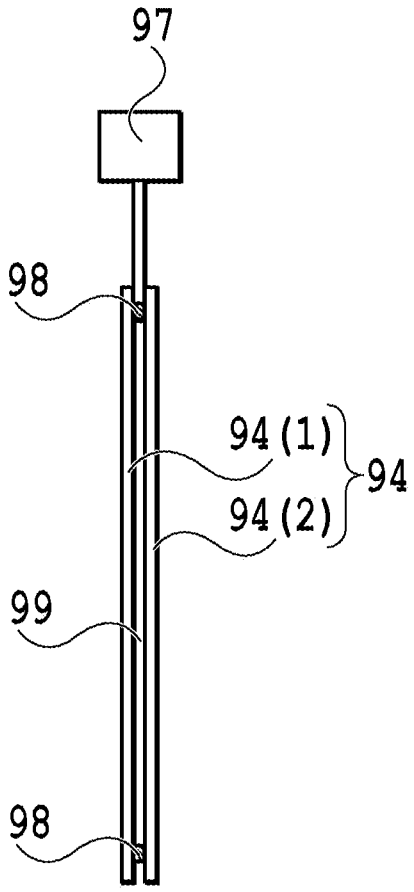
FIG. 15B is a configuration diagram of the sealing portion of the first and second films constituting the flexible membrane in FIG. 14.

As illustrated in FIGS. 15A and 15B, the flexible membrane 94 has a structure in which two flexible films (first film 94(1) and second film 94(2)) are joined to each other at their peripheries to be sealed in a bag shape, and a sealing portion 98 is provided at the peripheries of these films 94(1) and 94(2). While the structure (sealing portion 98) sealing the two flexible films (first film 94(1) and second film 94(2)) in a bag shape may be formed by joining, the structure may also be formed by other methods. For example, the structure may be formed by a method using the spacer and the O-rings described in the first embodiment without the air suction port and the liquid discharge port. An inter-film space 99 sealed between the first film 94(1) and the second film 94(2) is set at a pressure (negative pressure) lower than the pressures in the storing spaces 91 and 92, which are controlled to be equal. As mentioned above, the first film 94(1) and the second film 94(2) can be connected to each other by bonding, fusing, or the like. However, if the first film 94(1) and the second film 94(2) can be in tight contact with each other at least partly and moved as a single body by setting the inside of the inter-film space 99 at low pressure, these films do not need to be connected to each other by fusing or the like but may only need to be in contact with each other. On the other hand, by setting the inside of the inter-film space 99 at low pressure, the first film 94(1) and the second film 94(2) may possibly be brought into tight contact with each other such that no pressure change occurs when the flexible membrane 94 is damaged. To address this, it is desirable to form at least one of these films into a protruding or recessed shape and/or interposing a spacer between the two films to leave a space therebetween, as described in the first embodiment. In this way, it is possible to prevent the two films from coming into tight contact with each other and thus immediately measure a pressure change with the pressure measurement unit 97 upon damage of the flexible membrane 94 (film).

The thickness of the flexible membrane 94 is preferably 10 μm or more and 200 μm or less and more preferably 50 μm or less. For the flexible membrane 94, a fluororesin (such as FPA) film or the like that is high in chemical resistance and low in amount of metal dissolution is preferably used, for example.

The pressure measurement unit 97 measures the pressure in the inter-film space 99 and sends the measurement data to the control unit 57 of the liquid ejection apparatus. The control unit 57 detects whether the flexible membrane 94 is damaged based on change in the pressure measurement data. If detecting damage of the flexible membrane 94, the control unit 57 at least stops the ejection of the resin 90 from the ejection head 55 in the imprinting apparatus. The imprinting apparatus includes a control unit that outputs a signal to stop the imprinting apparatus upon detection of damage of the flexible membrane 94.

The pressure control unit 56 includes a tank for the operating liquid 93, a pipe, a pressure sensor, a pump, a valve, and so on. The pressure control unit 56 controls the pressure of the operating liquid 93 inside the second storing space 92. The control unit 57 controls the supply of the operating liquid 93 from the pressure control unit 56 to the second storing space 92 to control the pressure of the resin 90 inside the first storing space 91 indirectly with the flexible membrane 94. As a result, as in the above embodiments, the internal pressures of the first storing space 91 and the second storing space 92 are balanced so as to maintain a negative pressure for forming an appropriate meniscus inside each ejection port of the ejection head 55. This enables good ejection of the resin 90.

As the ejection of the resin 90 from the ejection head 55 in the series of imprinting actions is repeated, the amount of the resin 90 inside the first storing space 91 decreases. Accordingly, the flexible membrane 94 moves so as to decrease the capacity of the first storing space 91 and increase the capacity of the second storing space 92. This movement of the flexible membrane 94 replenishes the operating liquid 93 in the second storing space 92 from the tank for the operating liquid 93 in the pressure control unit 56. The resin 90, used in the imprinting apparatus 50, is a resin in which foreign matters (small particles) and metal ions have been reduced to extremely small amounts, and needs to maintain this state until being ejected from the ejection head 55. The imprinting apparatus 50 in this embodiment holds the resin 90 isolated from the outside of the first storing space 91 during the entire period until the resin 90 inside the first storing space 91 is consumed substantially completely by repetition of ejection of the resin 90. Thus, the resin 90 is free from contact with devices such as a pressure sensor. This makes it possible to suppress increase of foreign matters and metal ions persistently from the state where the resin 90 is sealed in the first storing space 91.

Figure 16:
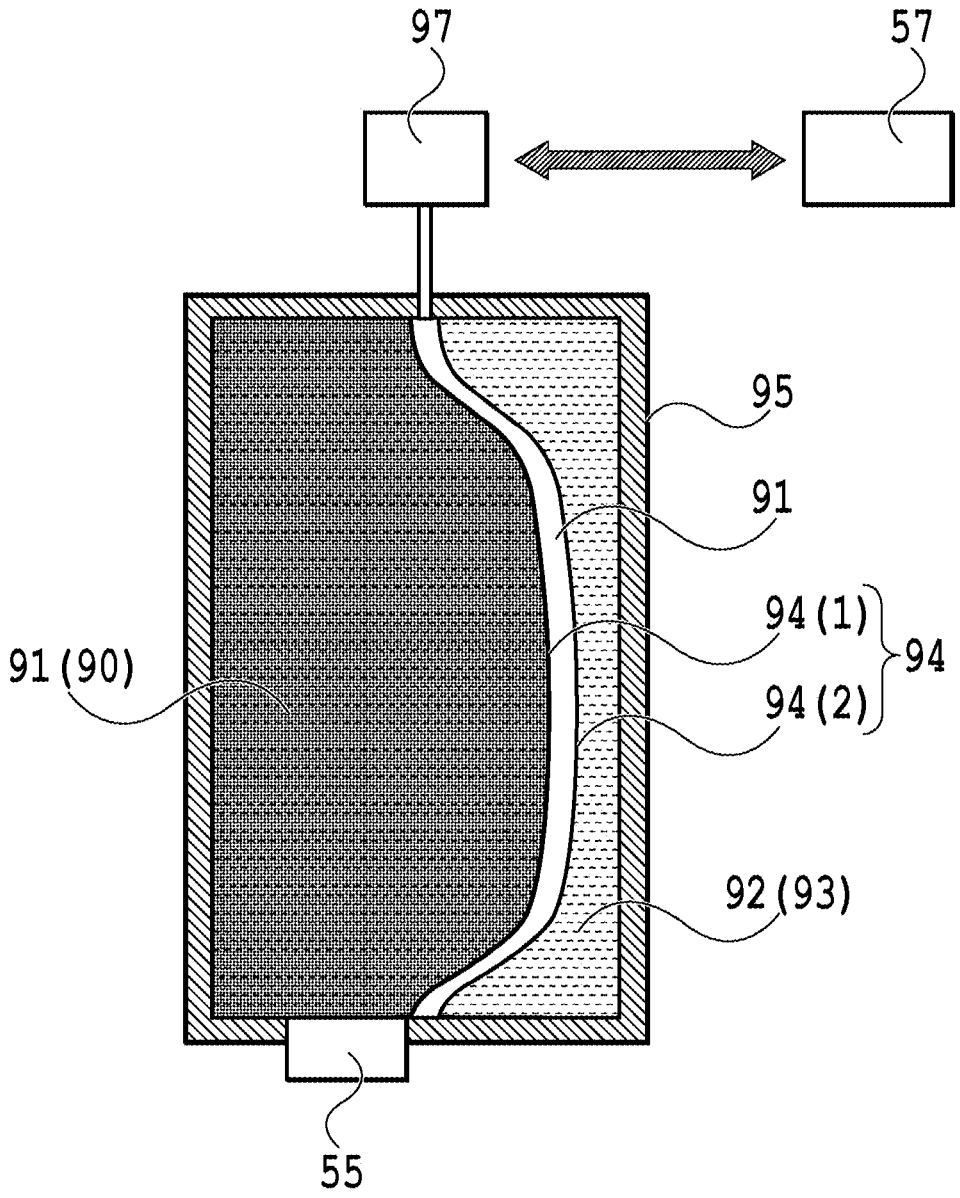
FIG. 16 is a configuration diagram of a storing container in FIG. 14.

FIG. 16 is a cross-sectional view of the storing container including the flexible membrane 94. The flexible membrane 94 separates the first storing space 91, storing the resin 90, the second storing space 92, storing the operating liquid 93, from each other. If the first film 94(1) on the first storing space 91 side is damaged (a hole is formed in the first film 94(1)), the resin 90 inside the first storing space 91 will enter the inter-film space 99 from the damaged spot of the first film 94(1) since the pressure in the inter-film space 99 is set lower than the pressure in the first storing space 91. In this situation, the resin 90 inside the inter-film space 99 does not get mixed into the operating liquid 93 inside the second storing space 92 since the second film 94(2) is present. As described above, as soon as the first film 94(1) is damaged, the pressure inside the inter-film space 99 rises and this pressure change is measured by the pressure measurement unit 97. Based on this measurement data, the control unit 57 detects the damage of the flexible membrane 94 and issues an instruction to stop the operation of the imprinting apparatus 50. Similarly, if the second film 94(2) on the second storing space 92 side is damaged (a hole is formed in the second film 94(2)), the operating liquid 93 inside the second storing space 92 will enter the inter-film space 99 and, based on the resultant change in the pressure inside the inter-film space 99, the damage of the flexible membrane 94 can be detected. Similarly, if the two films 94(1) and 94(2) are damaged at the same time, the damage of the flexible membrane 94 can be detected based on the resultant change in the pressure inside the inter-film space 99.

Figure 17:
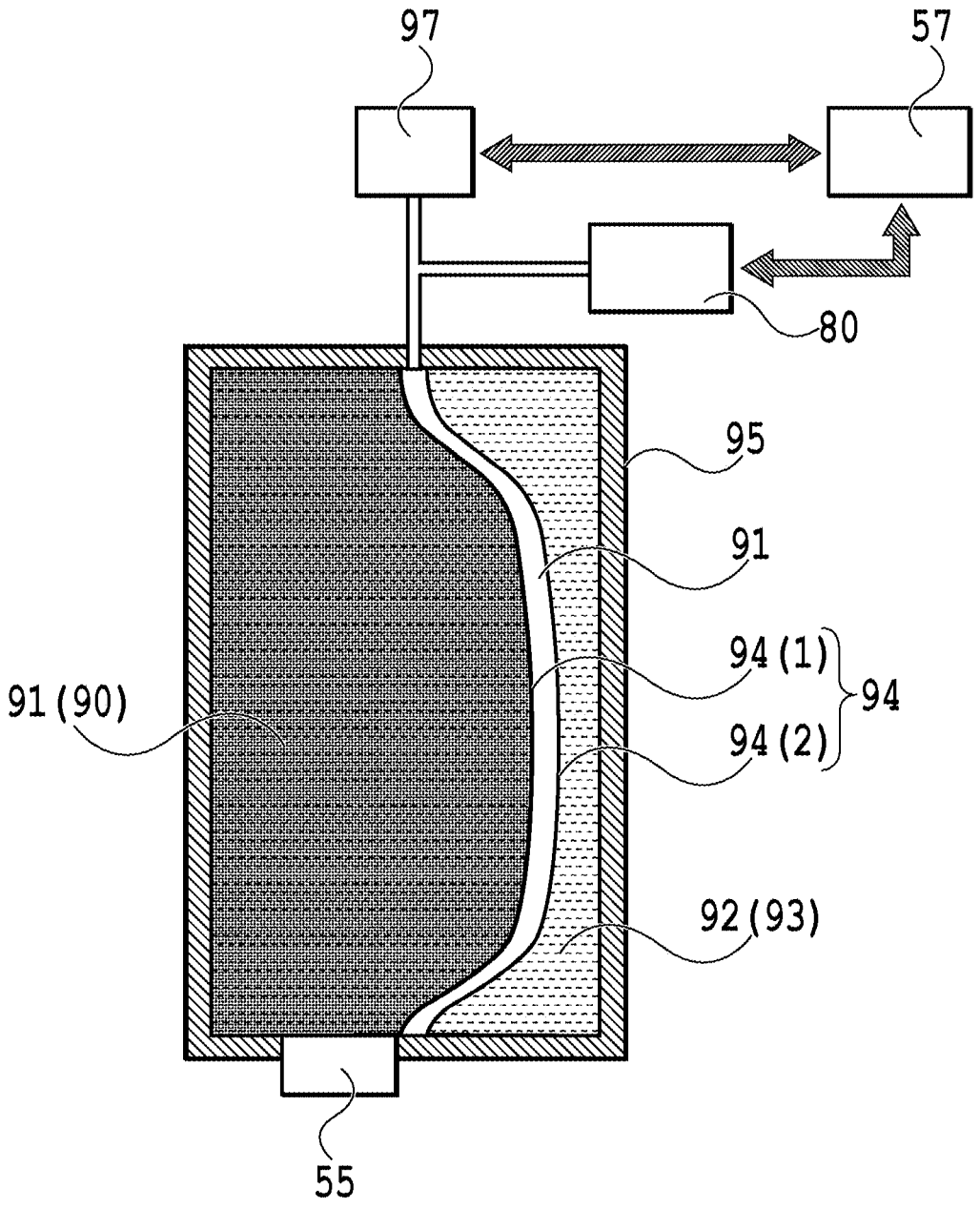
FIG. 17 is a configuration diagram of the storing container equipped with a pressure control unit.

Meanwhile, as illustrated in FIG. 17, a pressure control unit 80 including a pump and so on may be provided in order to maintain the pressure inside the inter-film space 99. In the case where the period for which the storing container 95 is mounted is prolonged, there is a possibility that the pressure inside the inter-film space 99 changes gradually and the pressure difference between the inter-film space 99 and the storing spaces 91 and 92 decreases. In this case, if the pressure control unit 80, capable of adjusting the internal pressure of the inter-film space 99, is provided, the internal pressure of the inter-film space 99 can be maintained at a predetermined pressure lower than the internal pressures of the storing spaces 91 and 92 by actuating the pressure control unit 80 as needed.

As described above, the imprinting apparatus in this embodiment can instantly detect damage of the flexible film. This can enhance the throughput yield of the product (device) manufactured by the imprinting apparatus, and also shorten the time for recovery such as cleaning due to damage of the flexible membrane and accordingly improve the rate of operation.

(Product Manufacturing Method)

An imprinting technique as described above can form three-dimensional structures at once and is therefore applicable to manufacturing techniques for diffractive optical elements and bio chip-type inspection elements. Further, since an imprinting technique as described above can form patterns on the order of nanometers, it is applicable to a wide range of fields such as next-generation semiconductor lithography techniques.

Patterns formed using an imprinting apparatus are permanently used in at least part of various products or temporarily used to manufacture various products. The products refer to electric circuit elements, optical elements, MEMS, recording elements, sensors, molds, and so on. The electric circuit elements include volatile and non-volatile semiconductor memories such as DRAMs, SRAMs, flash memories, and MRAMs, semiconductor elements such as such as LSI circuits, CCDs, image sensors, and FPGAs, and so on. The molds include molds for imprinting and so on.

Figure 18:
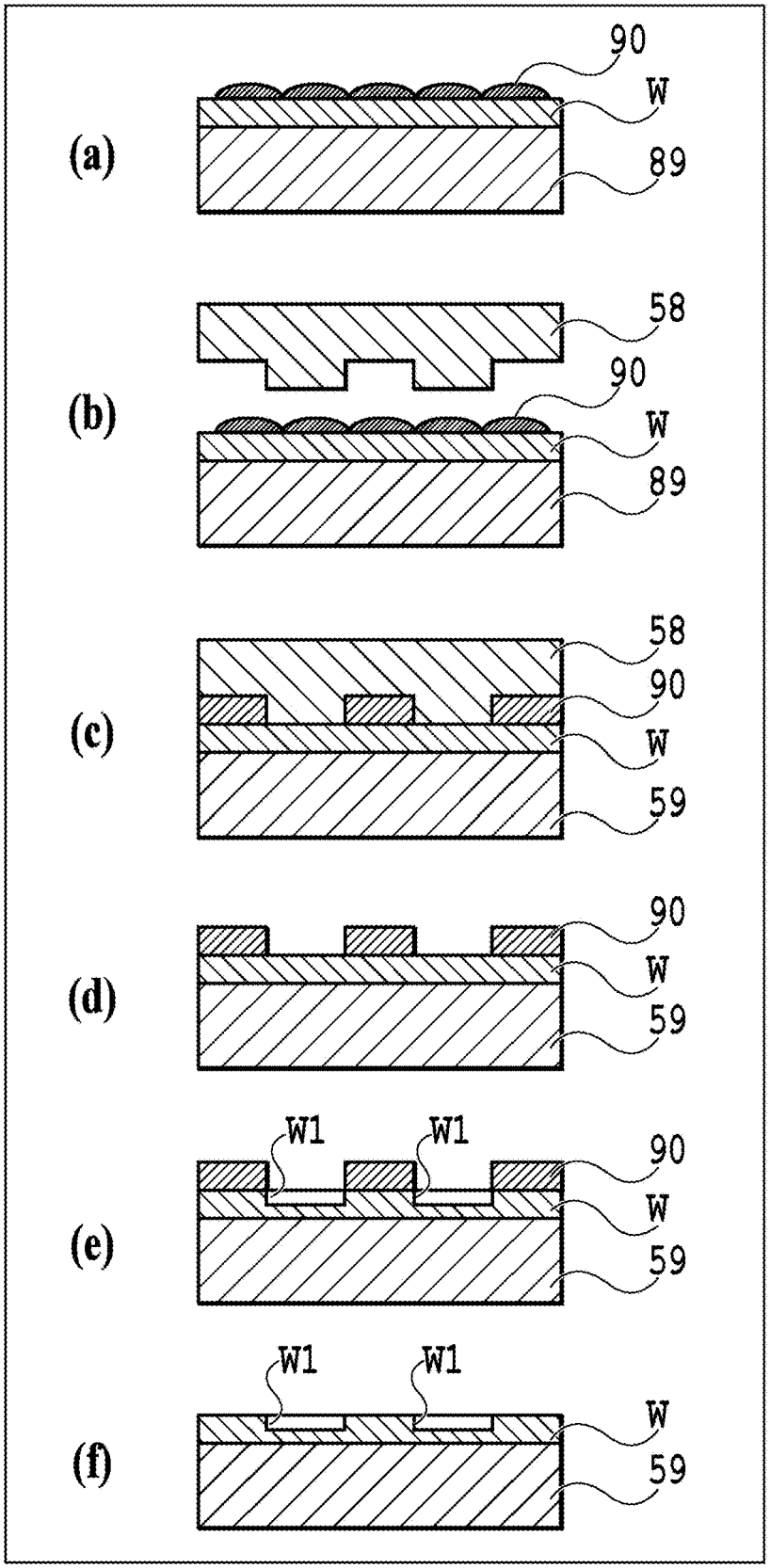
FIG. 18 is an explanatory diagram of an imprinting method using the imprinting apparatus in FIG. 13.

FIG. 18 is an explanatory diagram of a specific product manufacturing method.

First, as illustrated in part (a) of FIG. 18, a substrate 59 such as a silicon wafer with a workpiece material W such as an insulative material formed on its surface is prepared. Resin 90 as an imprint material is applied to the surface of the workpiece material W. Part (a) of FIG. 18 illustrates a state where the resin 90 has been applied in droplets to the surface of the workpiece material W. Then, as illustrated in part (b) of FIG. 18, the recessed-protruding pattern on a mold 58 for imprinting and the surface of the workpiece material W are oriented to face each other. As illustrated in part (c) of FIG. 18, the recessed-protruding pattern on the mold 58 is impressed into the surface of the workpiece material W. The resin 90 gets filled in the gaps between the mold 58 and the workpiece material W. In this state, the resin 90 is irradiated with light 60 serving as energy for curing through the mold 58 to be cured.

Then, as illustrated in part (d) of FIG. 18, the mold 58 is released, so that a pattern of the resin 90 is formed above the substrate 59. The protruding portions of this pattern correspond to the recessed portions of the mold 58, and the recessed portions of the pattern correspond to the protruding portions of the mold. Thus, the recessed-protruding pattern on the mold 58 is transferred above the substrate 59. Then, as illustrated in part (e) of FIG. 18, etching is performed using the pattern of the resin 90 above the substrate 59 as an etch-resistant mask, so that the portions of the surface of the workpiece material W on which the pattern of the resin 90 is absent or a thin layer of the resin 90 remains are removed and become grooves W1. Then, as illustrated in part (f) of FIG. 18, the pattern of the resin 90 is removed. As a result, a product with the grooves W1 formed in the surface of the workpiece material W is obtained. The pattern of the resin 90 may not be removed but used, for example, as an inter-layer insulation membrane included in a semiconductor element or the like, i.e., a constituent member of the product.

Seventh Embodiment

Figure 19:
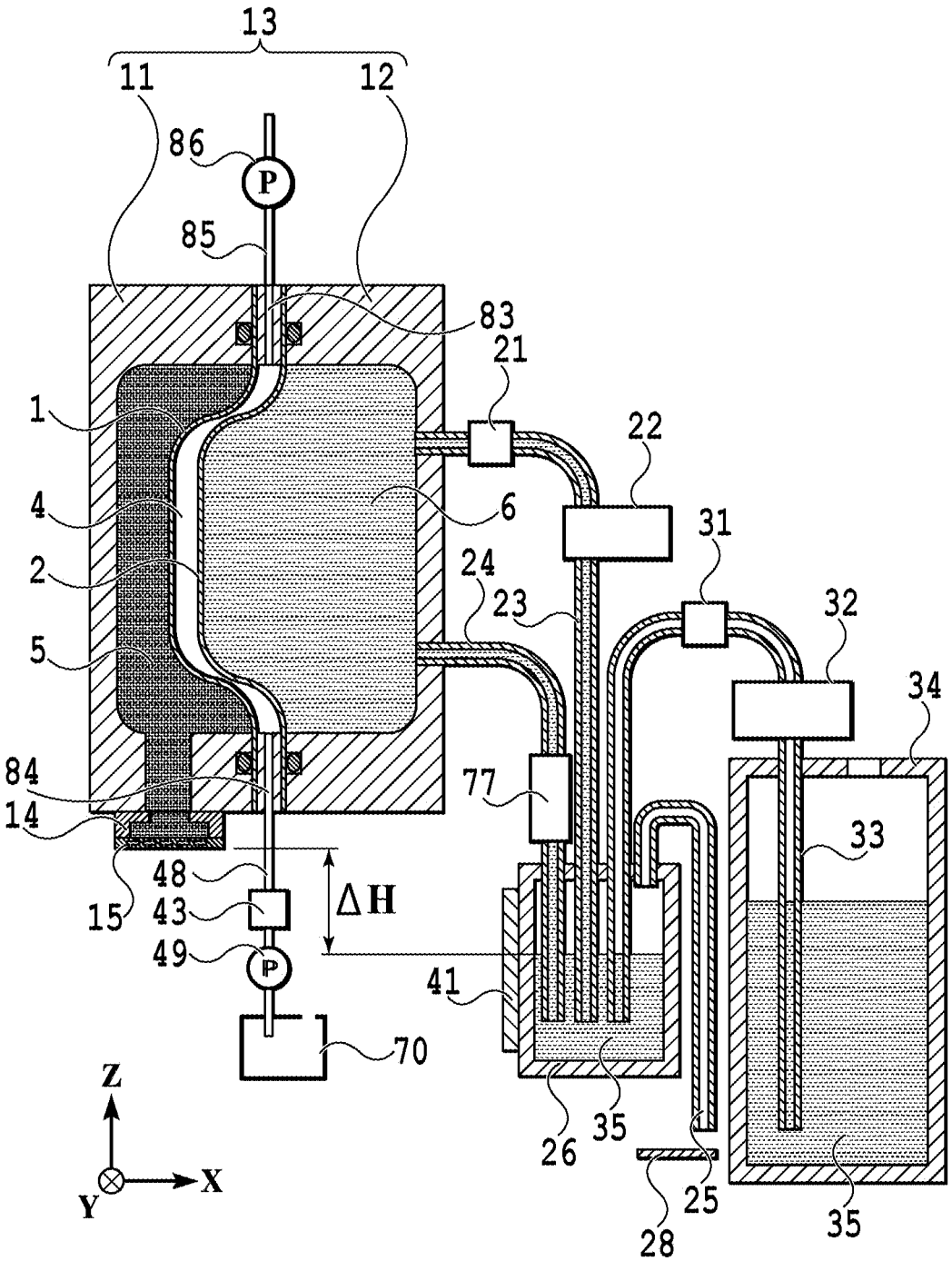
FIG. 19 is a configuration diagram of an ejection apparatus in a seventh embodiment of the present invention.

FIG. 19 is a diagram for explaining a seventh embodiment of the present invention, in which a discharge tube 48 is connected to a liquid discharge port 84. A liquid leakage sensor 43 and a discharge pump 49 are connected to the discharge tube 48, and the lower end of the discharge tube 48 is connected to a waste-liquid container 70. An air suction tube 85 is connected to an air suction port 83. A pressurizing pump 86 is connected to the air suction tube 85, and an end of the air suction tube 85 is open to the atmosphere. As in the above embodiments, films 1 and 2 are partly connected to each other by fusing or the like, and the films 1 and 2 move as a single body to maintain the internal pressures of storing spaces 5 and 6 at equal pressure. Also, the films 1 and 2 do not need to be connected to each other by fusing or the like if the discharge pump 49 and a choke or the like not illustrated can maintain the inside of an inter-film space 4 in a negative-pressure state and bring the films 1 and 2 into tight contact with each other at least partly such that they can move as a single body.

In the above fifth embodiment, the discharge pump 49, provided for the liquid discharge port 84, sucks the outside air from the air suction port 83 through the inter-film space 4. In this case, the film 1 and the film 2 may possibly be brought into tight contact with each other such that the discharge pump 49 attempts to discharge leaking liquid (operating liquid or ejection liquid) having leaked out into the inter-film space 4 but it is difficult make the leaking liquid move and reach the liquid leakage sensor 43.

To address this, in the seventh embodiment of the present invention, the air suction tube 85, connected to the air suction port 83, is equipped with the pressurizing pump 86. By using this pressurizing pump 86 to temporarily suck and pressurize the atmospheric air to send it into the inter-film space 4, the film 1 and the film 2 are prevented from coming into tight contact with each other, thereby facilitating flow of leaking liquid (operating liquid or ejection liquid) having leaked out into the inter-film space 4. In this way, the leaking liquid having leaked out into the inter-film space 4 can be sucked and discharged through the discharge tube 48 and more quickly reach and be certainly detected by the liquid leakage sensor 43.

Also, when the outside air is sucked from the air suction port 83 through the inter-film space 4, the internal pressures of the storing spaces 5 and 6 are negative pressure. Thus, it is preferable to maintain the pressure inside the inter-film space 4 at a negative pressure slightly lower than the atmospheric pressure to cause the outside air to flow into the inter-film space 4 to such an extent that the films come into tight contact with each other partly. Also, the timing to suck the outside air is preferably not when the ejection-material ejection apparatus is ejecting droplets, but when the ejection-material ejection apparatus is not ejecting droplets. In this way, it is possible to prevent the change in the pressure inside the inter-film space 4 from influencing the ejection performance such as the amount and speed of ejection of a droplet.

Also, if, in the fifth embodiment, the film 1 and the film 2 are in tight contact with each other such that it is difficult for leaking liquid to move, as mentioned above, another method to facilitate the movement is to provide protrusions 72 as multiple linking portions between the film 1 and the film 2, as illustrated in FIG. 5B. The shape of the protrusions is not limited. For example, linear protrusions or recesses may be provided to form flow channels. Further, it is desirable to provide these protrusions 72 over the entirety of a film molded in a protruding shape. By forming protrusions as described above and thereby forming regions where the film 1 and the film 2 do not come into tight contact with each other, the flow of leaking liquid (operating liquid or ejection liquid) having leaked out into the inter-film space 4 is facilitated. In this way, the leaking liquid having leaked out into the inter-film space 4 can be sucked and discharged through the discharge tube 48 and more quickly reach and be certainly detected by the liquid leakage sensor 43. Further, by adding the pressurizing operation by the pressurizing pump 86 in FIG. 19, it is possible to further facilitate the flow of the leaking liquid (operating liquid or ejection liquid) and more certainly detect the leaking liquid. Meanwhile, the film 1 and the film 2 themselves may be provided with protrusions or recesses when these films are molded, by providing the protrusions or recesses in the molds for molding the films.

Eighth Embodiment

Figure 20:
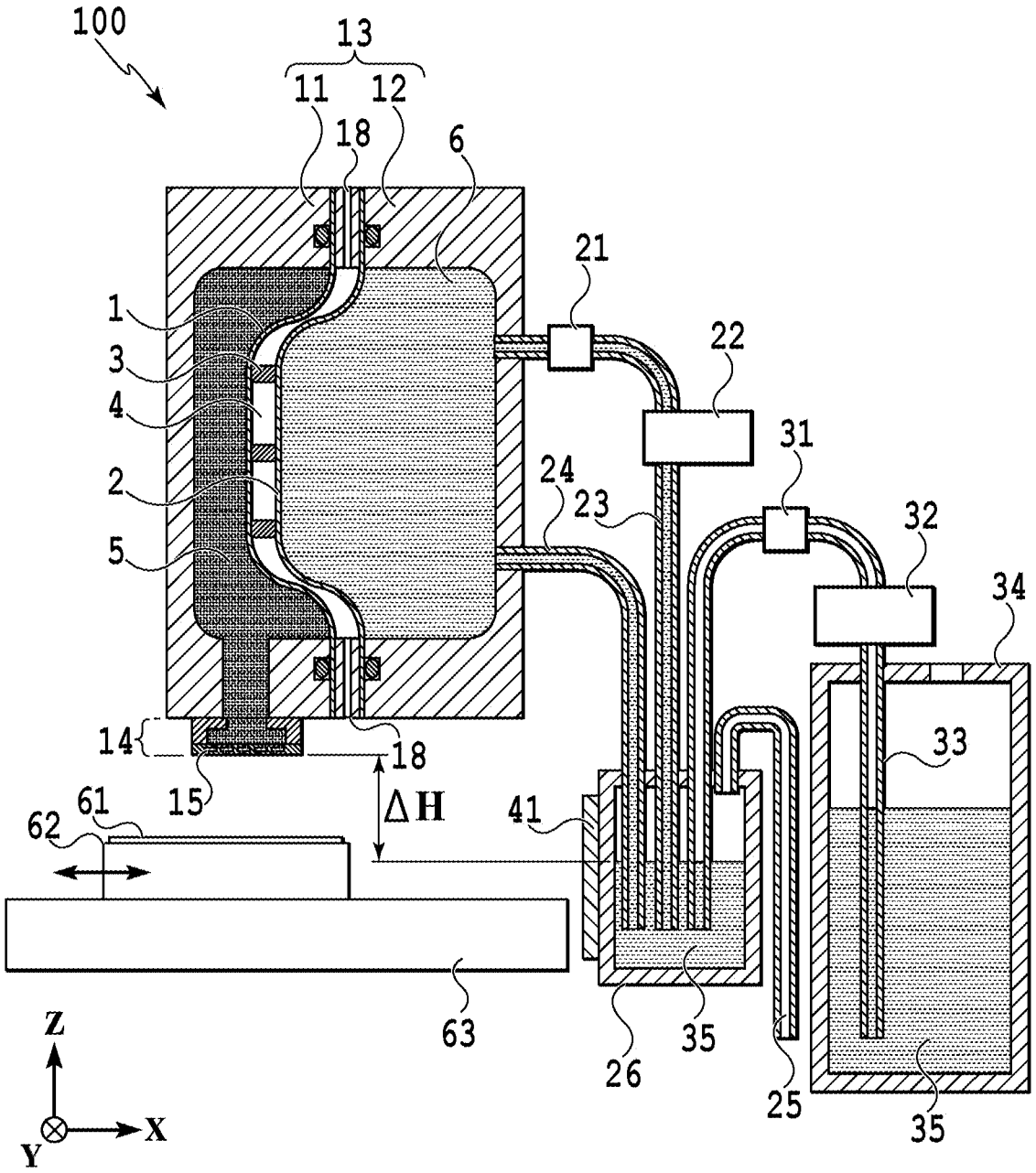
FIG. 20 is a diagram illustrating the configuration of an ejection apparatus in an eighth embodiment of the present invention.

An eighth embodiment of the present invention will now be described with reference to FIGS. 20 and 21. The eighth embodiment is a configuration that detects film damage with the liquid level sensor 41 in the first embodiment without using the liquid leakage sensor 42 and the flow speed sensor 77 in the first embodiment. The basic configuration of this embodiment is similar to that of the first embodiment. Only a characteristic configuration will therefore be described below.

As in the first embodiment, the internal pressure of the first storing space 5, containing the ejection material, is controlled to a value lower than the outside air pressure by 0.40±0.04 kPa by setting the value of the height difference Δ H to 41 mm±4 mm. In this control, the liquid level of the operating liquid 35 inside the sub tank 26 may only need to be at a position within the range of −37 mm to −45 mm from the position of the ejection surface, at which the ejection ports 15 open, in the Z direction in FIG. 19, which is along the vertical direction. Then, the liquid level adjustment may just need to be done by disposing an upper limit sensor and a lower limit sensor at the −37-mm position and the −45-mm position from the ejection ports 15 in the Z direction and adjusting the position of the liquid level so as to maintain the liquid level constantly between the two sensors. The upper limit sensor and the lower limit sensor are level sensors that detect when the liquid level reaches a set upper limit level and when the liquid level reaches a set lower limit level.

On the other hand, to detect rise of the liquid level inside the sub tank 26 upon film damage, a displacement sensor capable of detecting a change in liquid level is needed. For this reason, the liquid level sensor 41 in this embodiment is configured as a displacement sensor capable of detecting a change in position of the liquid level within the range of −25 mm to −55 mm from the ejection ports 15 in the Z direction. The liquid level sensor 41 thus configured has both the function of an upper limit sensor and a lower limit sensor for adjusting the liquid level and the function of a liquid-level displacement sensor for detecting film damage.

When calculating the height difference Δ H, the control apparatus (the CPU 202 in FIG. 2) calculates two types of values, namely, the amount of change in the position of the liquid level and the rate of change in the position of the liquid level per given time interval (hereinafter, also referred to as 'liquid-level change speed') from the height of the liquid level measured by the liquid level sensor 41. The liquid level of the operating liquid 35 inside the sub tank 26 is sometimes detected to abruptly change due to a vibration such as an earthquake, for example. However, when the liquid level changes due to an earthquake, the liquid-level change speed is detected to switch between positive and negative values. In contrast, when the liquid level of the operating liquid inside the sub tank 26 rises due to film damage as described earlier, the liquid-level change speed is detected only in the positive direction. Thus, the control apparatus can recognize the change in liquid level due to a vibration such as an earthquake and the change in liquid level due to film damage as different changes based on how the liquid-level change speed changes.

Meanwhile, the operating liquid 35 is supplied from the main tank 34 to the sub tank 26 to maintain the value of the height difference Δ H within a certain range, as described earlier. For this supply operation, the amount of the liquid to be sent is already known, as described earlier, and also the liquid-level change speed is calculated by the control apparatus. If film damage occurs while the operating liquid 35 is being sent, the liquid-level change speed will be detected to be higher than the known value. This makes it possible to recognize an abnormal state.

With the above configuration, when the height difference Δ H is corrected, it is also possible to calculate the cumulative value of the amount of the operating liquid supplied from the main tank 34 to the sub tank 26 for replenishment. Specifically, the cumulative value of the amount of the operating liquid supplied for replenishment is equal to the amount of decrease of the ejection material inside the first storing space 5. Thus, it is possible to simultaneously figure out the total amount of the ejection material ejected and the amount of the ejection material remaining inside the first storing space 5. This function makes it possible to figure out the relation between the duration of use of the storing container 13 and the amount of the remaining liquid and calculate a predicted remaining life.

Figure 21A:
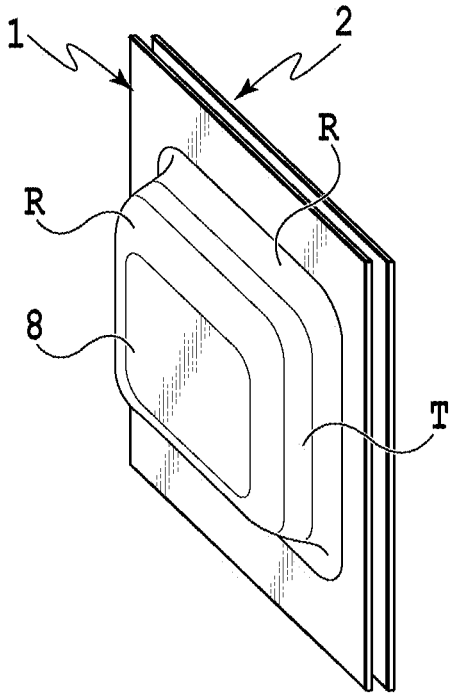
FIG. 21A is a perspective view of a first film and a second film in FIG. 20.
Figure 21B:
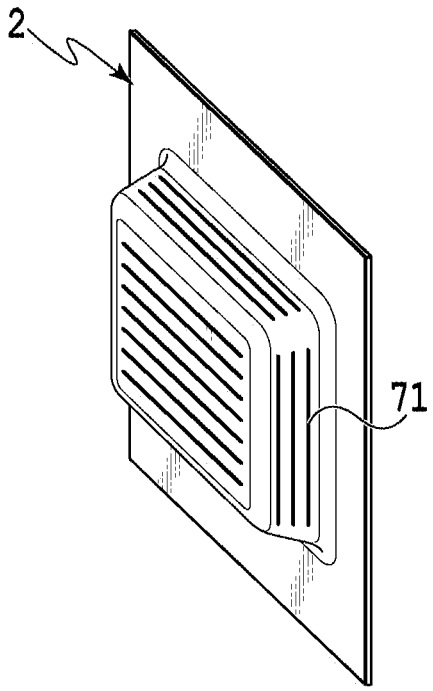
FIG. 21B is a perspective view of the second film in FIG. 20.

FIGS. 21A and 21B are explanatory diagrams of the first and second films 1 and 2 in this embodiment. These two films are placed one over the other as illustrated in FIG. 21A. Then, fusing lines 71 illustrated in FIG. 21B are irradiated with laser light from a laser processing machine to thereby thermally fuse irradiated portions to each other. As a result, a laminate of the two films partly connected to each other is obtained. The portions along the fusing lines 71 are linking portions 3. Since the specifications of the fusing lines 71 such as their forms and number do not directly affect the gist of the present invention, specific description thereof is omitted here. The space between the two films is designed to communicate with the outside air (atmosphere) through vents 18.

Ninth Embodiment

A ninth embodiment of the present invention will now be described with reference to a drawing. The ninth embodiment is a configuration that detects operating liquid pushed out into the sub tank 26 due film damage by using means different from the eighth embodiment. The basic configuration of this embodiment is similar to that of the eighth embodiment. Only a characteristic configuration will therefore be described below.

Figure 22:
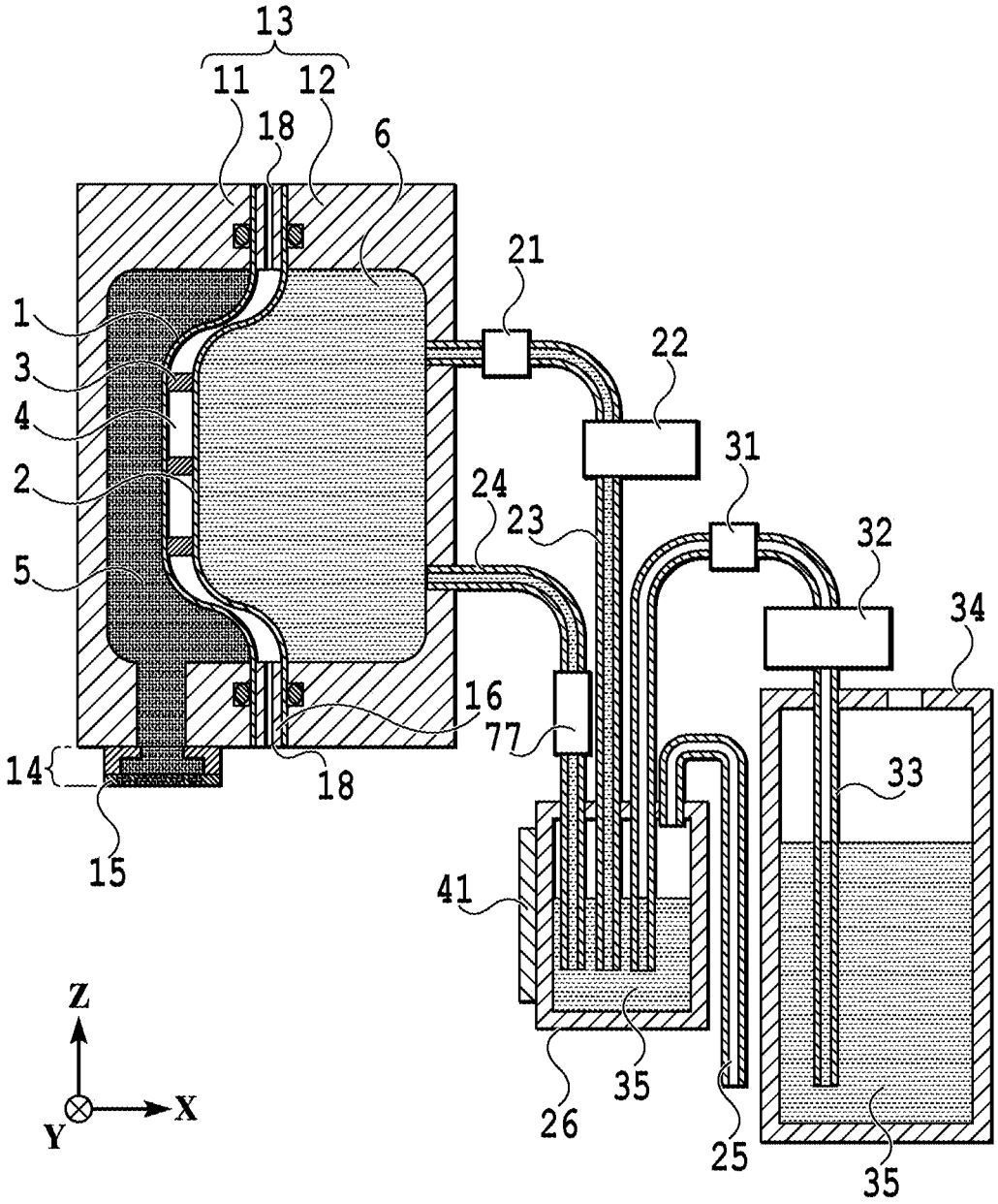
FIG. 22 is a diagram illustrating the configuration of an ejection apparatus in a ninth embodiment of the present invention.

FIG. 22 illustrates the ninth embodiment of the present invention. In FIG. 22, a flow speed sensor 77 is installed on the tube 24, through which the second storing space 6 and the inside of the sub tank 26 communicate with each other. If the first film 1 or the second film 2 is damaged, the operating liquid 35 will be pushed out of the second storing space 6 toward the sub tank 26. Since the operating liquid thus pushed out travels through the tube 24, its flow speed can be detected by the flow speed sensor 77.

On the other hand, when the ejection material is ejected from the ejection ports 15, the operating liquid is sucked (supplied) from the sub tank 26 in the amount of this ejection toward the second storing space 6. Since the operating liquid thus sucked travels through the tube 24, its flow speed can be detected by the flow speed sensor 77, but its direction of flow is opposite from the direction of flow upon occurrence of film damage. Thus, the flow of the operating liquid due to ejection of the ejection material and the flow of the operating liquid due to film damage are opposite from each other in plus/minus sign of the value of the flow speed and can therefore be clearly distinguished from each other.

Also, when the operating liquid 35 in the sub tank 26 is replenished from the main tank 34 to maintain the value of the height difference $\Delta H$ within the predetermined range, the sending of the liquid is done through the tube 33, and the tube 24 is not involved in it. Thus, the flow speed sensor 77 detects no flow speed.

Thus, with the configuration of this embodiment, the occurrence of film damage can be detected based on the flow speed detection by the flow speed sensor 77. Note that a similar advantageous effect can be achieved also by using a flow rate sensor instead of the flow speed sensor 77. Specifically, the occurrence of film damage can be detected by detecting the flow rate of the operating liquid 35 traveling from the second storing space 6 toward the sub tank 26 with a flow rate sensor.

In this embodiment too, even if the first film 1 or the second film 2 is damaged, the ejection material and the operating liquid will not contact each other since they are separated from each other. This makes it possible to prevent deterioration of the ejection material by contact.

Also, if film damage occurs, the internal pressure of the first storing space 5 can rise until becoming equal to the outside air pressure. This leads to a possibility that the ejection material inside each ejection port 15 fails to maintain the state of forming the meniscus 17 and drips out of the ejection port 15 at an unintended time. However, the ejection apparatus in this embodiment can detect abnormality at the point when the internal pressure of the first storing space 5 turns to rise, and issue an abnormality alarm based on that detection. This makes it possible to implement dripping prevention before the ejection material drips.

10th Embodiment

A 10th embodiment of the present invention will now be described with reference to a drawing. The 10th embodiment is a configuration that directly detects film damage from a change in internal pressure. The basic configuration of this embodiment is similar to that of the eighth embodiment. Only a characteristic configuration will therefore be described below.

Figure 23:
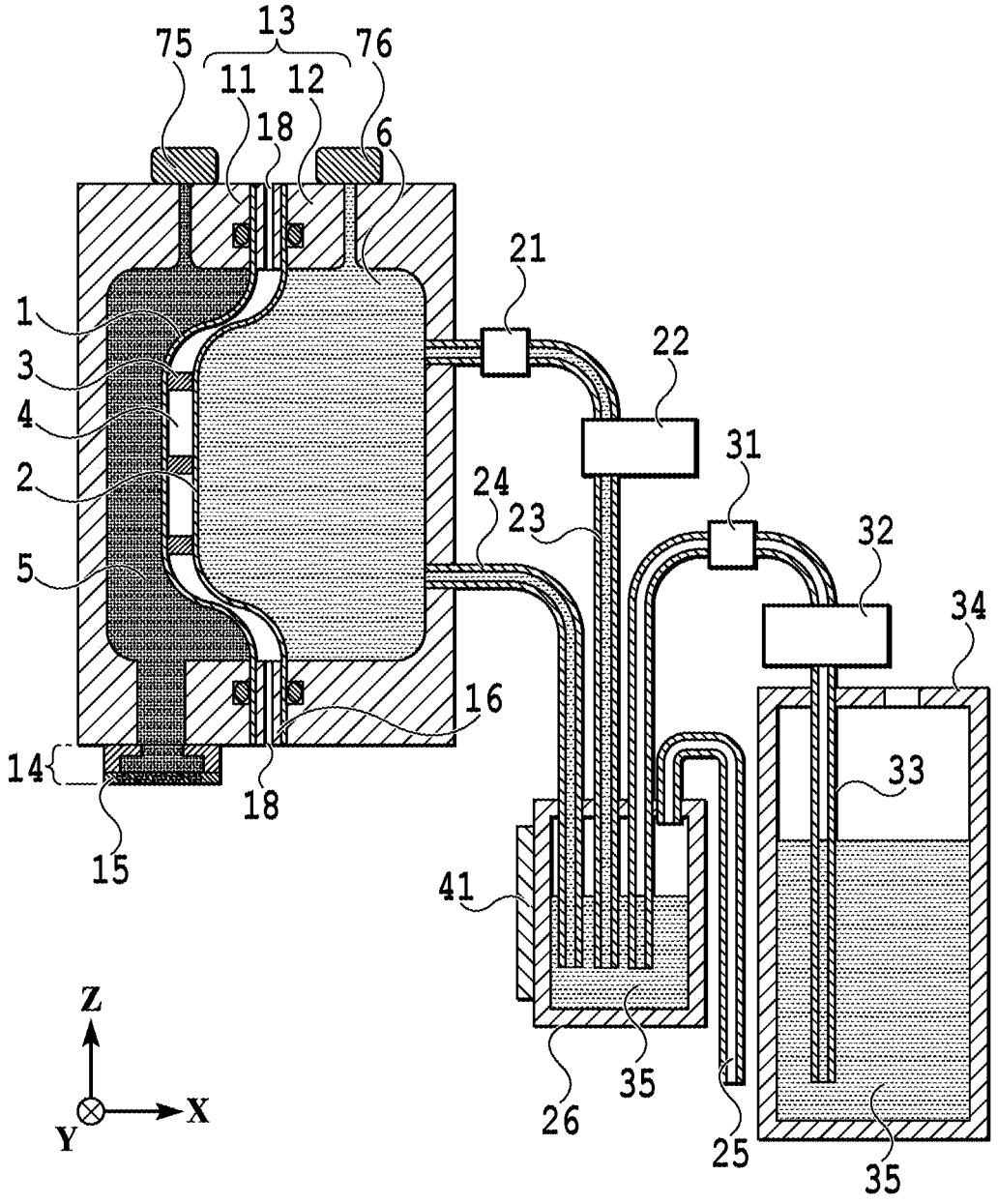
FIG. 23 is a diagram illustrating the configuration of an ejection apparatus in a 10th embodiment of the present invention.

FIG. 23 illustrates the 10th embodiment of the present invention. In FIG. 23, pressure sensors 75 and 76 for monitoring internal pressure are installed which monitor the internal pressures of the first storing space 5 and the second storing space 6, respectively. If the first film 1 or the second film 2 is damaged, air bubbles will enter the first storing space 5 or the second storing space 6 from the inter-film space 4 through the damaged spot. As mentioned above, since the internal pressure of the air bubbles is the atmospheric pressure and the internal pressures of the first storing space 5 and the second storing space 6 are negative pressure lower than the atmospheric pressure, the internal pressure of the storing space which the air bubbles have entered rises. Thus, it is possible to detect the occurrence of film damage based on the detection of rise in internal pressure by the pressure sensor 75 or 76 for monitoring internal pressure.

With the configuration of this embodiment, rise in internal pressure can be detected directly. This makes it possible to detect abnormality quickly after its occurrence and issue an abnormality alarm based on that detection. It is therefore possible to implement dripping prevention before the ejection material drips.

In this embodiment too, even if the first film 1 or the second film 2 is damaged, the ejection material and the operating liquid will not contact each other since they are separated from each other. This makes it possible to prevent deterioration of the ejection material by contact.

In this embodiment, one pressure sensor is provided for each storing space, therefore two pressure sensors in total. However, a similar advantageous effect can be achieved also by providing a pressure sensor for either one of the storing spaces.

11th Embodiment

An 11th embodiment of the present invention will now be described with reference to a drawing. The 11th embodiment is a configuration including multiple means for detecting the occurrence of film damage. The basic configuration of this embodiment is similar to that of the eighth embodiment. Only a characteristic configuration will therefore be described below.

Figure 24:
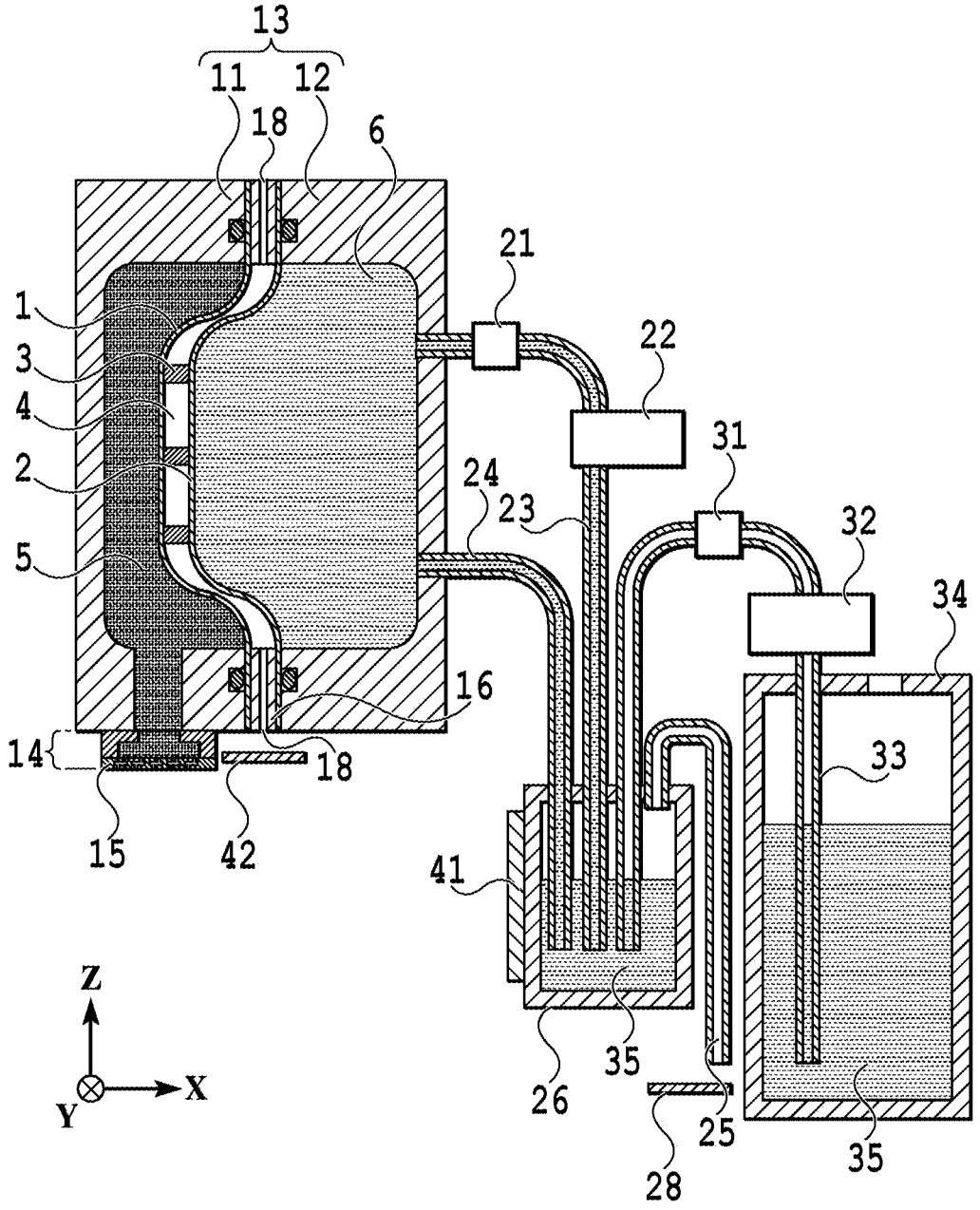
FIG. 24 is a diagram illustrating the configuration of an ejection apparatus in an 11th embodiment of the present invention.

FIG. 24 illustrates the 11th embodiment of the present invention. In FIG. 24, the ceiling surface of the inside of the sub tank 26 is disposed at a position lower than the ejection ports 15 of the ejection head 14. Also, in FIG. 24, the inside of the sub tank 26 communicates with the outside air through the tube 25, which functions also as an air suction port. A full-level sensor 28 is disposed at the exit of the tube 25. Specifically, the full-level sensor 28 is a leakage sensor that reacts to the operating liquid. Examples of the full-level sensor 28 include sensors such as optical sensors and conduction-short circuit detection-type sensors. Also, a leakage sensor 42 is disposed under one of the vents 18 between the first film 1 and the second film 2. The leakage sensor 42 is a sensor that reacts to the operating liquid and/or the ejection material. Examples of the leakage sensor 42 include sensors such as optical sensors and conduction-short circuit detection-type sensors.

In this configuration, upon occurrence of film damage, air bubbles are sucked into the corresponding storing space, so that the internal pressure of the second storing space 6, which has been adjusted to negative pressure, starts rising and the operating liquid 35 flows into the sub tank 26 from the second storing space 6. Since the ceiling surface of the inside of the sub tank 26 is lower in height than the ejection ports 15 of the ejection head 14, the sub tank 26 will be full before the internal pressure of the second storing space 6 reaches the pressure equal to the atmospheric pressure. Thereafter, the operating liquid 35 overflows from inside the sub tank 26 to the outside through the tube 25. The overflowing operating liquid 35 is detected by the full-level sensor 28.

Also, as film damage occurs and air bubbles are sucked into the corresponding storing space, the ejection material or the operating liquid moves (leaks) from the storing space into the inter-film space 4. This ejection material or operating liquid then drip by gravity. The dripping ejection material or operating liquid is detected by the leakage sensor 42.

With the above configuration, if film damage occurs, it is possible to detect when the sub tank 26 becomes full, before the internal pressure of the corresponding storing space becomes equal to the atmospheric pressure. For example, even if the liquid level sensor 41 is malfunctioning and not detecting any change in height of the liquid level and therefore failing to detect film damage, it is still possible to detect the film damage by detecting the leakage of the operating liquid 35 with the full-level sensor 28 or by detecting the leakage of the ejection material or the operating liquid with the leakage sensor 42.

As described above, in this embodiment, redundant detecting functions using multiple detectors prevents failure to detect film damage. Note that although this embodiment uses three detectors, namely, the liquid level sensor 41, the full-level sensor 28, and the leakage sensor 42, the present invention is not limited to this. Specifically, in the present invention, there may be one detector or detecting function to detect the occurrence of film damage, and two or more detectors or detecting functions may be used to enhance the effect of preventing failure to detect the occurrence of film damage.

In this embodiment too, even if the first film 1 or the second film 2 is damaged, the ejection material and the operating liquid will not contact each other since they are separated from each other. This makes it possible to prevent deterioration of the ejection material by contact.

If film damage occurs, the internal pressure of the first storing space 5 can rise until becoming equal to the outside air pressure. This leads to a possibility that the ejection material inside each ejection port 15 fails to maintain the state of forming the meniscus 17 and drips out of the ejection port 15 at an unintended time. However, in this embodiment, it is possible to detect abnormality before the internal pressure of the ejection head reaches the atmospheric pressure, and issue an abnormality alarm based on that detection. It is therefore possible to implement dripping prevention before the ejection material drips.

12th Embodiment

A 12th embodiment of the present invention will now be described with reference to a drawing. The 12th embodiment is a configuration in which the inter-film space is a sealed space. The basic configuration of this embodiment is similar to that of the eighth embodiment. Only a characteristic configuration will therefore be described below.

Figure 25:
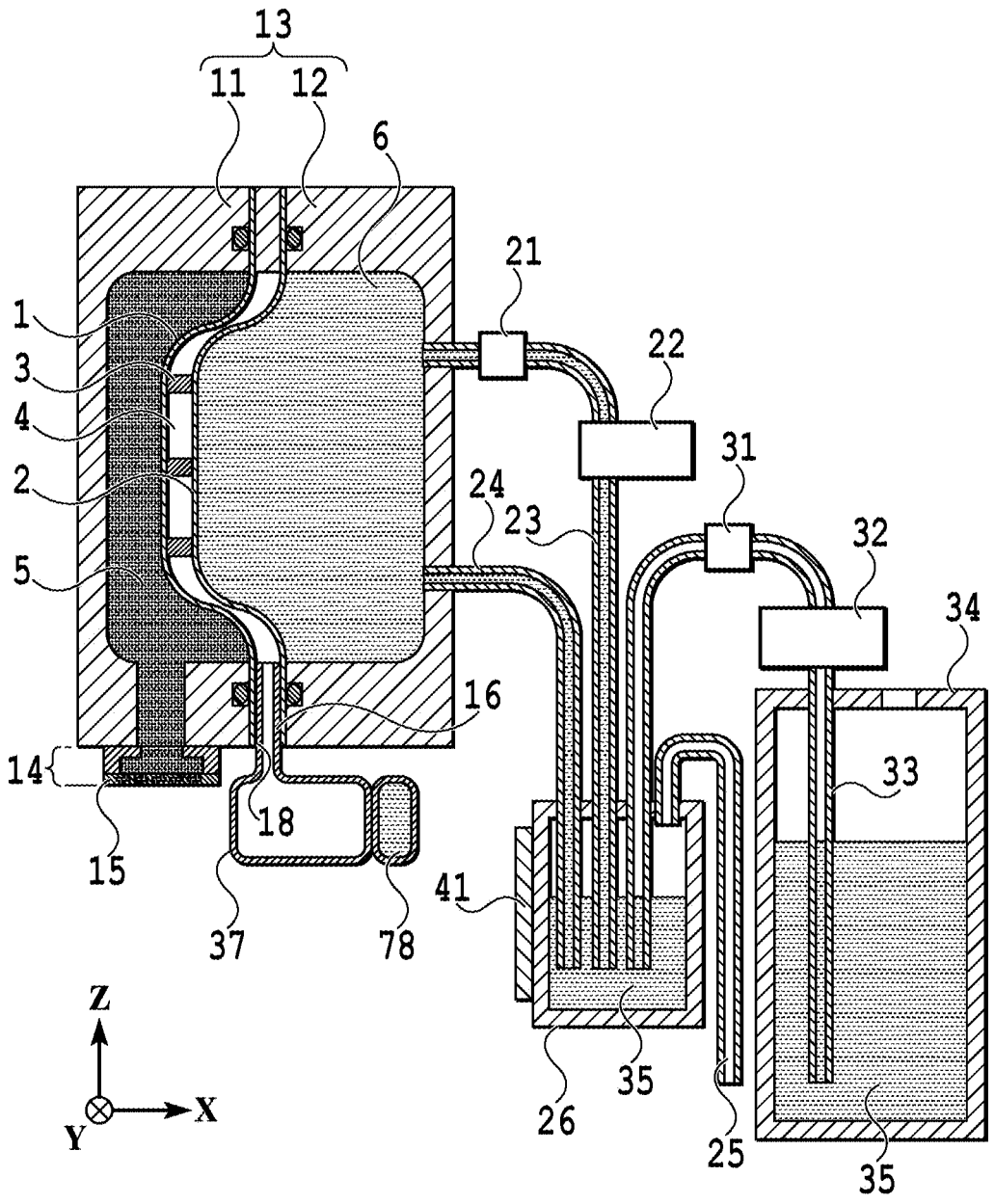
FIG. 25 is a diagram illustrating the configuration of an ejection apparatus in a 12th embodiment of the present invention.

FIG. 25 illustrates the 12th embodiment of the present invention. In the 12th embodiment, the inter-film space 4 is formed as a sealed space, and a measuring unit that measures the flow of a gas flowing into the sealed space is further provided. Specifically, in the 12th embodiment, illustrated in FIG. 25, the first film 1 and the second film 2 are closed in such a bag shape as to sandwich the linking portions 3 and the inter-film space 4 between them and have an opening portion at one end. A connection port of a gas tank 37 is hermetically connected to this opening portion so that air will not leak from between them. This connected portion serves as a suction port for air moving from the inside of the gas tank 37, which is outside the inter-film space 4, toward the inside of the inter-film space 4. A flow rate sensor 78 is disposed to measure the flow rate of air passing this connected portion (suction port).

The body of the gas tank 37 is situated outside the storing container 13, and the internal space (pooled air) of the body of the gas tank 37 communicates with the inter-film space 4. A tank with such strength as not to be deformed by change in internal pressure under the use condition (pressure condition) in this embodiment is used as the gas tank 37.

As mentioned above, if the first film 1 or the second film 2 is damaged, the air in the inter-film space 4 will pass through the damaged spot of the film and be sucked into the first storing space or the second storing space in the form of air bubbles 74. Also, this rises the pressure inside the storing space and accordingly pushes the operating liquid 35 out of the second storing space 6 toward the sub tank 26. At the same time, air outside the inter-film space 4, specifically, the air in the internal space of the gas tank 37, is sucked into the inter-film space 4 to supply air of the volume of the air bubbles 74 sucked into the storing space. Consequently, a flow of air is formed.

The flow rate sensor 78 detects the flow of air moving from the internal space of the gas tank 37 toward the inter-film space 4 at a significant flow rate. Thus, the occurrence of the film damage can be detected.

Meanwhile, the same advantageous effect can also be achieved by similarly using a flow speed sensor in place of the flow rate sensor 78. Specifically, it is possible to detect the occurrence of film damage by using a flow speed sensor to detect a flow of air moving from the internal space of the gas tank 37 toward the inter-film space 4 at a significant flow speed. To enhance the accuracy of the detection with the flow speed sensor, it is desirable to narrow the flow speed sensor's suction port to increase the flow speed.

In this embodiment too, even if the first film 1 or the second film 2 is damaged, the ejection material and the operating liquid will not contact each other since they are separated from each other. This makes it possible to prevent deterioration of the ejection material by contact.

If film damage occurs, the internal pressure of the first storing space 5 can rise until becoming equal to the outside air pressure. This leads to a possibility that the ejection material inside each ejection port 15 fails to maintain the state of forming the meniscus 17 and drips out of the ejection port 15 at an unintended time. However, upon occurrence of film damage, the ejection apparatus in this embodiment can detect the abnormality quickly after its occurrence based on the movement of air from the outside to the inside of the inter-film space 4 resulting from the film damage, and issue an abnormality alarm based on that detection. It is therefore possible to implement dripping prevention before the ejection material drips.

The configuration in which the inter-film space 4 is a sealed space limits the volume of air that flows into the storing space from the inter-film space 4 upon occurrence of film damage and accordingly reduces the increase in the internal pressure of the storing space. Hence, film damage can be detected and dripping of the ejection material from the ejection ports can be prevented with a smaller amount of inflow of gas.

13th Embodiment

A 13th embodiment of the present invention will now be described with reference to a drawing. The 13th embodiment is a configuration provided with a pressure adjustment mechanism capable of adjusting the internal pressure of the sub tank 26 among multiple pressures. The basic configuration of this embodiment is similar to that of the eighth embodiment. Only a characteristic configuration will therefore be described below.

Figure 26:
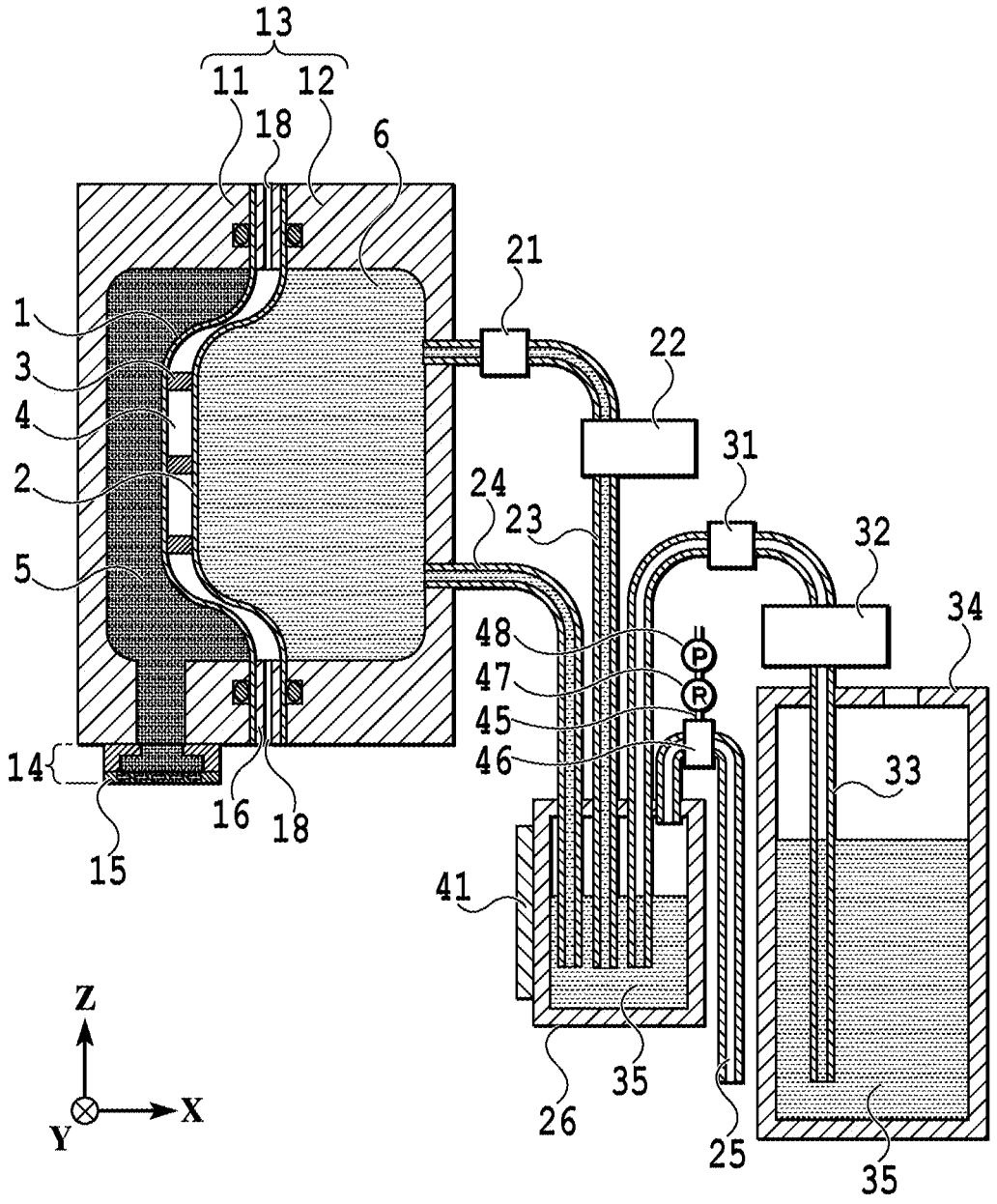
FIG. 26 is a diagram illustrating the configuration of an ejection apparatus in a 13th embodiment of the present invention.

FIG. 26 illustrates the 13th embodiment of the present invention. The tube 25 is connected to the sub tank 26. The distal end of the tube 25 is open to the atmosphere and a three-way valve 46 is connected to an intermediate portion of the tube 25, thereby making the inside of the sub tank 26 communicable with the atmosphere. A pressure adjustment tube 45 is connected to the three-way valve 46 so as to be communicable with three-way valve 46. A regulator 47 and a pump 48 are connected to the pressure adjustment tube 45.

When an ejection operation is performed to eject the ejection material from the ejection ports, the opening/closing of the three-way valve 46 is controlled to make the sub tank 26 communicate with the atmosphere and not communicate with the pressure adjustment tube 45.

To set the internal pressure of the sub tank 26 to a lower pressure (negative pressure) than the atmospheric pressure, the pump 48 is operated with the regulator 47 set to a predetermined pressure and the opening/closing of the three-way valve 46 is controlled to make the sub tank 26 and the pressure adjustment tube 45 communicate with each other. In this way, the internal pressure of the sub tank 26 can be controlled to be the negative pressure.

The internal pressure of the sub tank 26 can be controlled among multiple pressures by controlling the regulator 47. For example, the internal pressure of the sub tank 26 may be controlled with the regulator 47 to be a pressure (second pressure) that is lower than the pressure suitable for an ejection operation (first pressure) and does not break the meniscus of the ejection material in each ejection port 15. The pressure suitable for an ejection operation (first pressure) is, in other words, a pressure suitable as the steady internal pressure in the ejection head at the time of performing an ejection operation. Also, the pressure that is lower than the first pressure and does not break the meniscus of the ejection material in each ejection port 15 is a pressure at which the ejection material forms a meniscus in the ejection port and the position where the meniscus is formed is within the ejection port.

The pressure that does not break the meniscus of the ejection material in each ejection port 15 varies depending on factors such as the diameter of the ejection port, the surface tension of the ejection material, and so on, but may be a value lower than the outside air pressure by 0.40 kPa, for example.

To prevent change in the amount of ejection of the ejection material and the flying speed of the ejection material, the above control on the internal pressure of the sub tank 26 is desirably performed during non-ejection operations in which no ejection operation is performed.

Changing the internal pressure of the sub tank 26 may possibly change the internal pressures of the first storing space 5 and the second storing space 6 as well such that the ejection material leaks or drips out of the ejection ports 15, which communicate with the first storing space 5. Considering this possibility, it is desirable to perform the control to switch the internal pressure of the sub tank 26 while the ejection material is not situated at the ejection position for ejection from the ejection head 14 (e.g. the meniscus forming position illustrated in FIG. 3).

Also, to reduce troubles that can be caused by leakage and dripping of the ejection material, the control to switch the internal pressure of the sub tank 26 is desirably performed while the ejection head 14 is not moving, during replacement of the ejection-material storing container, and during maintenance of the ejection head 14.

In this embodiment, the flow speed of the operating liquid 35 flowing from the second storing space 6 toward the sub tank 26 due to film damage can be increased by making the inside of the sub tank 26 a closed space and setting the internal pressure of the sub tank 26 below the atmospheric pressure. This makes it possible to quickly detect the rise in liquid level inside the sub tank 26 and quickly detect the occurrence of film damage.

In this embodiment too, even if the first film 1 or the second film 2 is damaged, the ejection material and the operating liquid will not contact each other since they are separated from each other. This makes it possible to prevent deterioration of the ejection material by contact.

14th Embodiment

Figure 27:
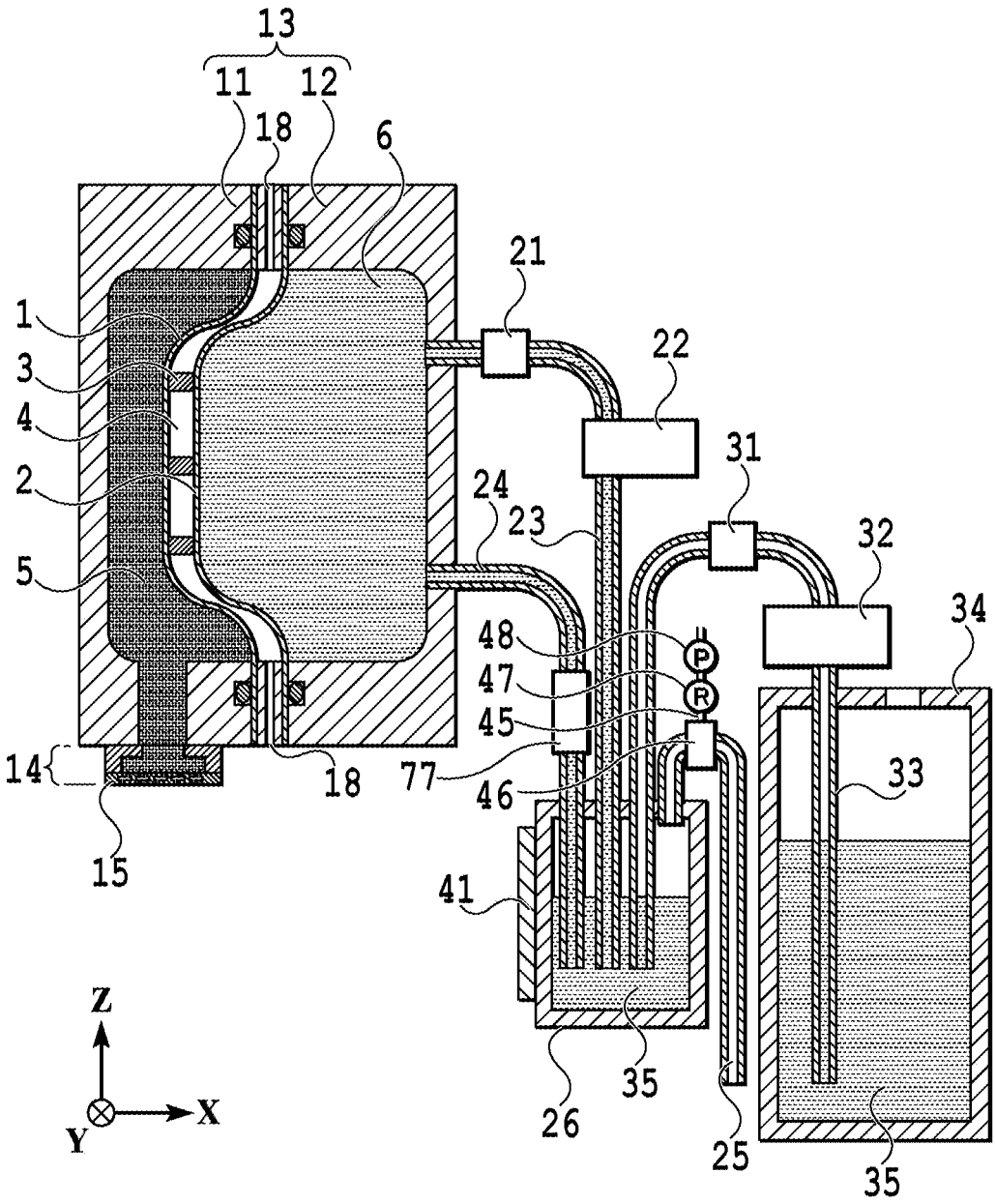
FIG. 27 is a diagram illustrating the configuration of an ejection apparatus in a 14th embodiment of the present invention.

FIG. 27 illustrates a 14th embodiment of the present invention. The 14th embodiment is a modification of the ninth embodiment and is the configuration of the ninth embodiment further provided with the pressure adjustment mechanism discussed in the 13th embodiment, which adjusts the internal pressure of the sub tank 26. The basic configuration of this embodiment is similar to those of the ninth and 13th embodiments, and description thereof is omitted.

In this embodiment, the flow speed of the operating liquid 35 flowing from the second storing space 6 toward the sub tank 26 through the tube 24 due to film damage can be increased by making the inside of the sub tank 26 a closed space and setting the internal pressure of the sub tank 26 below the atmospheric pressure. This makes it easier to quickly and accurately detect the flow speed with the flow speed sensor 77 and therefore enables quick and easy detection of the occurrence of film damage.

In this embodiment too, even if the first film 1 or the second film 2 is damaged, the ejection material and the operating liquid will not contact each other since they are separated from each other. This makes it possible to prevent deterioration of the ejection material by contact.

15th Embodiment

Figure 28:
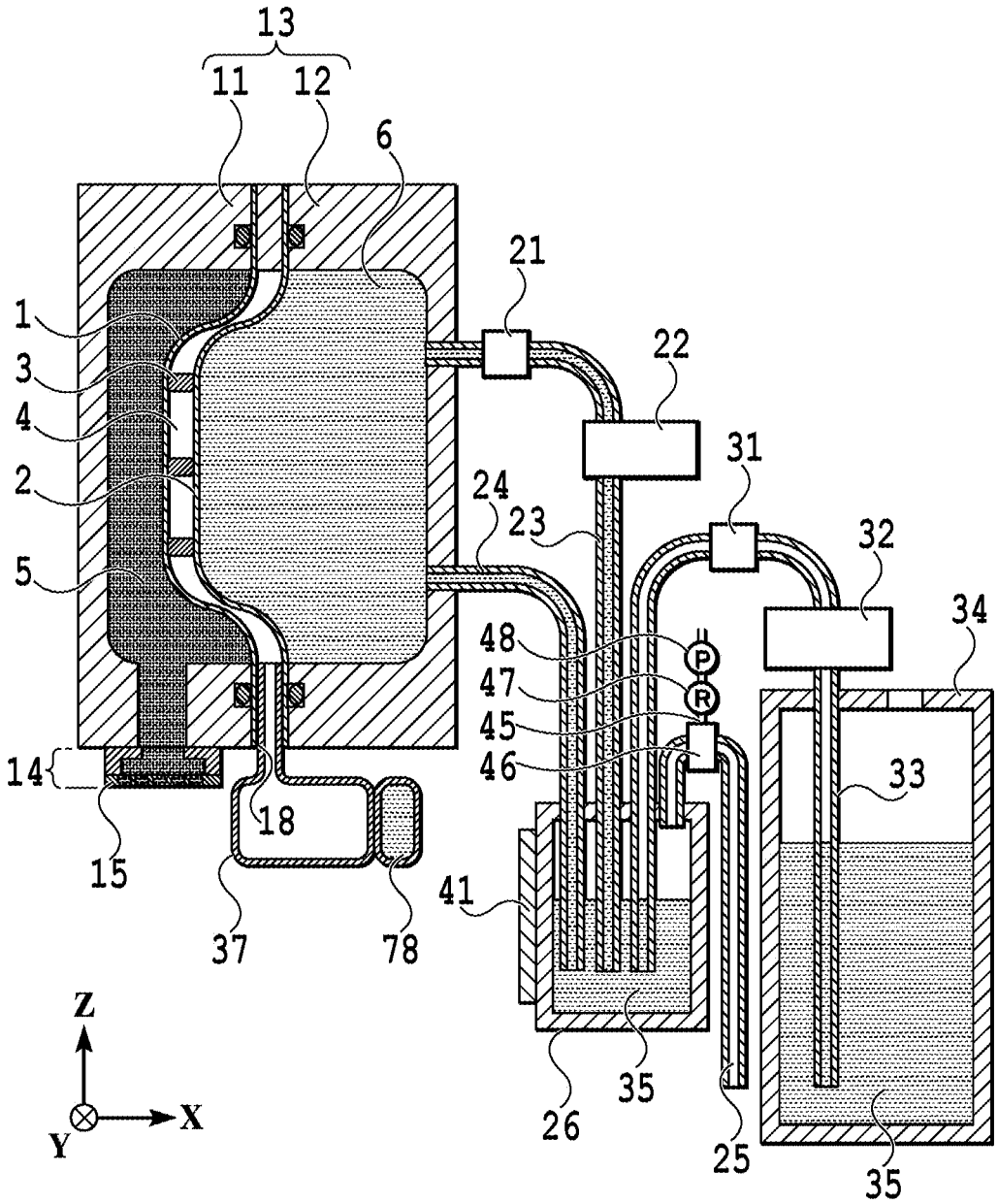
FIG. 28 is a diagram illustrating the configuration of an ejection apparatus in a 15th embodiment of the present invention.

FIG. 28 illustrates a 15th embodiment of the present invention. The 15th embodiment is a modification of the 12th embodiment, and is the configuration of the 12th embodiment further provided with the pressure adjustment mechanism discussed in the 13th embodiment, which adjusts the internal pressure of the sub tank 26. The basic configuration of this embodiment is similar to those of the 12th and 13th embodiments, and description thereof is omitted.

In this embodiment, the inside of the sub tank 26 is made a closed space, and the internal pressure of the sub tank 26 is set to be lower than the atmospheric pressure (to negative pressure). With the internal pressure controlled to be lower (with the absolute value of the negative pressure controlled to be larger), it is possible to increase the flow of the fluid moving from the second storing space 6 toward the sub tank 26 upon occurrence of film damage. This accordingly increases the flow of air flowing into the second storing space 6 from the inter-film space 4 and also increases the flow of air flowing into the inter-film space 4 from the internal space of the gas tank 37 through the connected portion (suction port). This in turn makes the flow rate detection by the flow rate sensor 78 easier and improves the detection accuracy. Hence, film damage can be detected more certainly. A similar advantageous effect can also be achieved by detecting the flow speed with the flow speed sensor 77 in place of the flow rate sensor 78.

In this embodiment too, even if the first film 1 or the second film 2 is damaged, the ejection material and the operating liquid will not contact each other since they are separated from each other. This makes it possible to prevent deterioration of the ejection material by contact.

16th Embodiment

Figure 29:
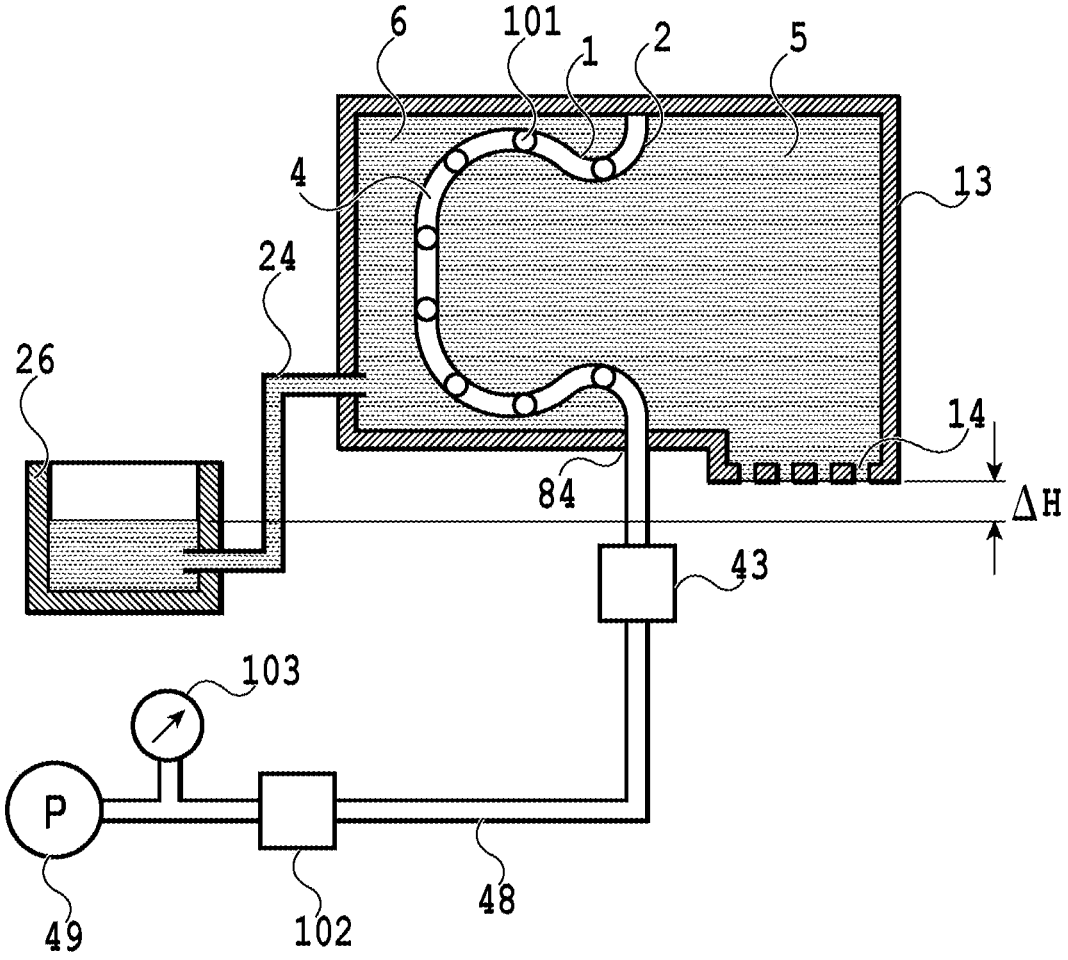
FIG. 29 is a configuration diagram of an ejection apparatus in a 16th embodiment of the present invention.

FIG. 29 is a diagram for explaining a 16th embodiment of the present invention. A discharge tube 48 is connected to a liquid discharge port 84, and a liquid leakage sensor 43, a flow speed meter (flow speed detector) 102, a pressure measurement gauge 103, and a discharge pump 49 are connected to the discharge tube 48. As in the above embodiments, films 1 and 2 are partly connected to each other by fusing or the like, and the films 1 and 2 move as a single body to maintain the internal pressures of storing spaces 5 and 6 at equal pressure. Also, the films 1 and 2 do not need to be connected to each other by fusing or the like if the discharge pump 49 and a choke or the like not illustrated can maintain the inside of an inter-film space 4 in a pressure lower than the internal pressures of the storing spaces 5 and 6 and bring the films 1 and 2 into tight contact with each other at least partly such that they can move as a single body.

Figure 30:
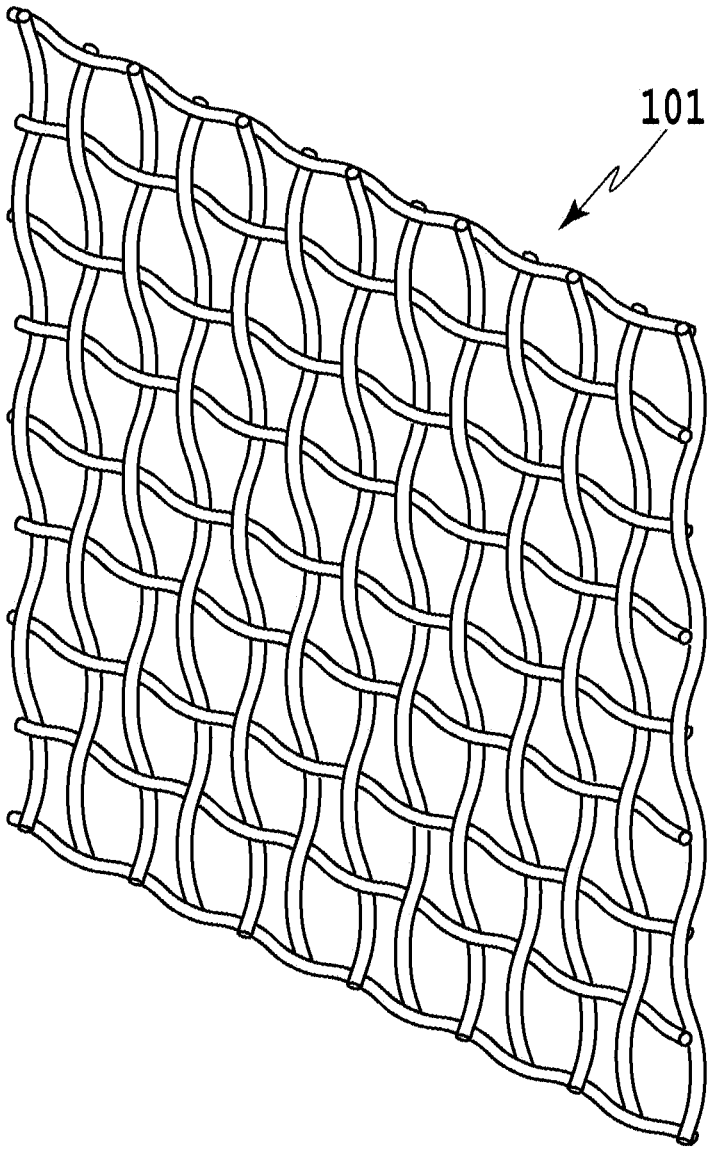
FIG. 30 is a perspective view of meshed thin resin in FIG. 29.

As illustrated in FIG. 29, meshed thin resin (meshed thin film resin) 101 illustrated in FIG. 30 is sandwiched between the films 1 and 2. As mentioned above, even with the inside of the inter-film space 4 maintained in a negative-pressure state, the films 1 and 2 can be prevented from coming into tight contact with each other. This makes it easier to detect liquid leakage upon damage of the film 1 and/or 2. Meanwhile, the films 1 and 2 may be fused to each other with the meshed thin resin 101 sandwiched between the films 1 and 2.

The material of the meshed thin resin 101 may only need to be a material resistant to the ejection material and the operating liquid, like the materials of the films 1 and 2. For example, tetrafluoroethylene-per-fluoroalkyl vinyl ether copolymer (PFA), ethylene tetrafluoroethylene (ETFE), and a Teflon (registered trademark)-based fluororesin such as polytetrafluoroethylene (PTFE) are usable. Also, examples include polyethylene (PE), polyvinyl chloride (PVC), polyethylene terephthalate (PET), polyvinyl alcohol (PVAL), polyvinylidene chloride (PVDC), and a polyamide synthetic resin such as nylon.

In a storing container 13 in FIG. 29, the inter-film space 4 does not have any opening communicating with the outside of the storing container 13 except for the liquid discharge port 84. Instead, in the case where the inter-film space 4 has another opening communicating with the outside of the storing container 13 in addition to the liquid discharge port 84, that other opening is closed with a valve. Thus, while the films are not damaged, there is no flow of gas (fluid) inside the discharge tube 48 and the measurement value of the flow speed meter 102 is therefore zero. On the other hand, if film damage occurs, there will be a flow of gas and the leaking liquid (fluid) inside the discharge tube 48. Then, by detecting the speed of that flow with the flow speed meter 102, it is possible to detect the film damage. Also, from the measurement value of the flow speed meter 102, it is possible to estimate the diameter of the hole formed in the film.

Note that the waste-liquid container 70 in the above seventh embodiment is not connected to the lower end of the discharge tube 48 in FIG. 29. However, as in the seventh embodiment, the waste-liquid container 70 may be connected to the lower end of the discharge tube 48.

17th Embodiment

Figure 31:
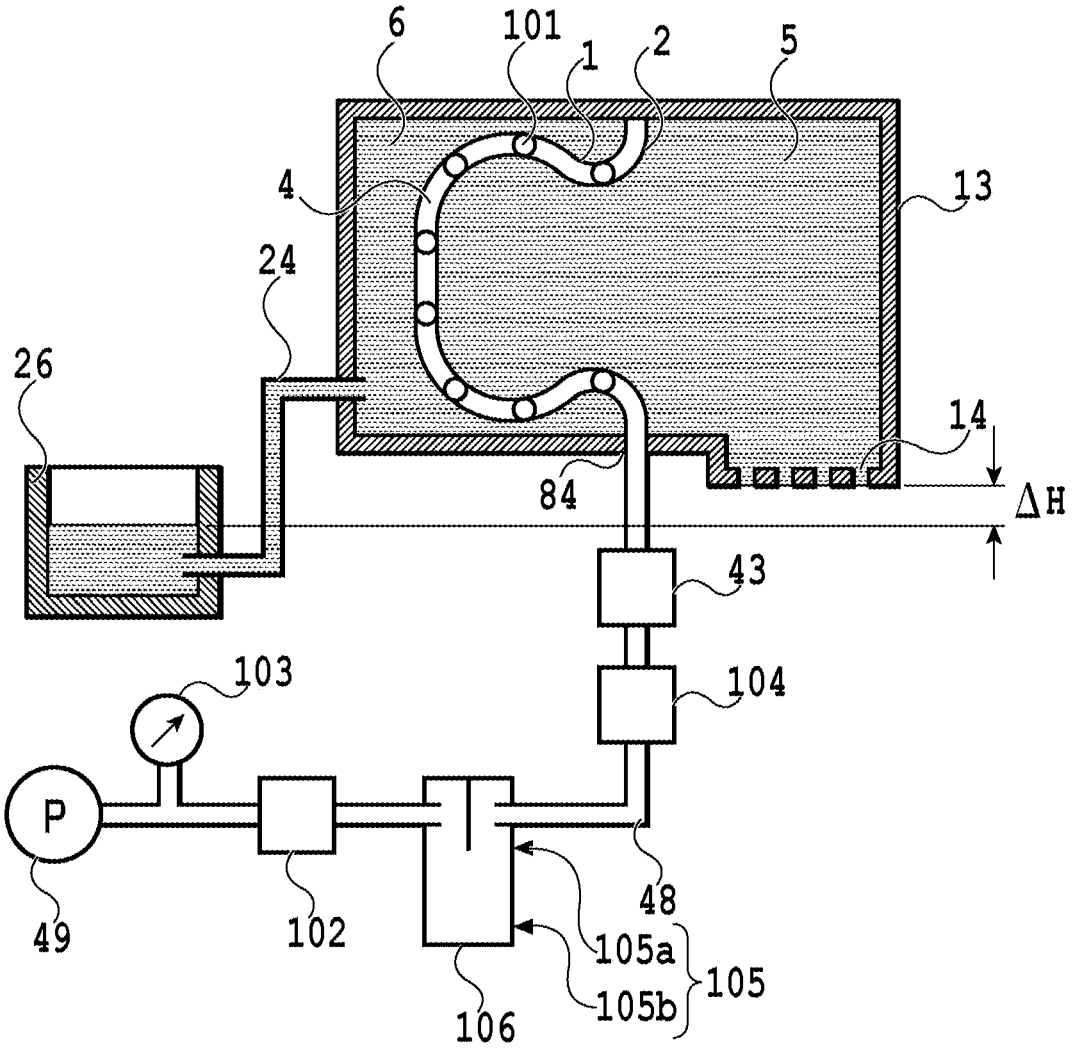
FIG. 31 is a configuration diagram of an ejection apparatus in a 17th embodiment of the present invention.

FIG. 31 is a diagram for explaining a 17th embodiment of the present invention. The 17th embodiment differs from the above 16th embodiment in that a color sensor 104 and a mist collector 106 are connected to the discharge tube 48. If a liquid flows into a flow speed meter 102 designed for use with gas, it may possibly cause a measurement error and damage the flow speed meter 102. By disposing the mist collector 106 at an intermediate portion of the discharge tube 48, it is possible to prevent a liquid from flowing into the flow speed meter 102 designed for use with gas. The mist collector 106 is provided with a liquid level sensor 105 for detecting the liquid level therein so that the discharge pump can be stopped before the liquid inside the mist collector 106 becomes full. The liquid level sensor 105 in this embodiment includes a sensor unit **105*a* that detects a high liquid level before the inside of the mist collector 106 becomes full, and a sensor unit 105*b* that detects a low liquid level when the inside of the mist collector 106 is nearly empty. The liquid level sensor 105 may just need to be capable of detecting at least the liquid level before the inside of the mist collector 106 becomes full. Also, by detecting the colored election liquid or colored operating liquid with the color sensor 104, it is possible to identify which film has been damaged, the film on the ejection liquid side or the film on the operating liquid side. Thus, by making the ejection liquid and the operating liquid differ in color and detecting the color of leaking liquid discharged from the liquid discharge port 84 with the color sensor 104**, it is possible to identify the damaged film.

18th Embodiment

Figure 32:
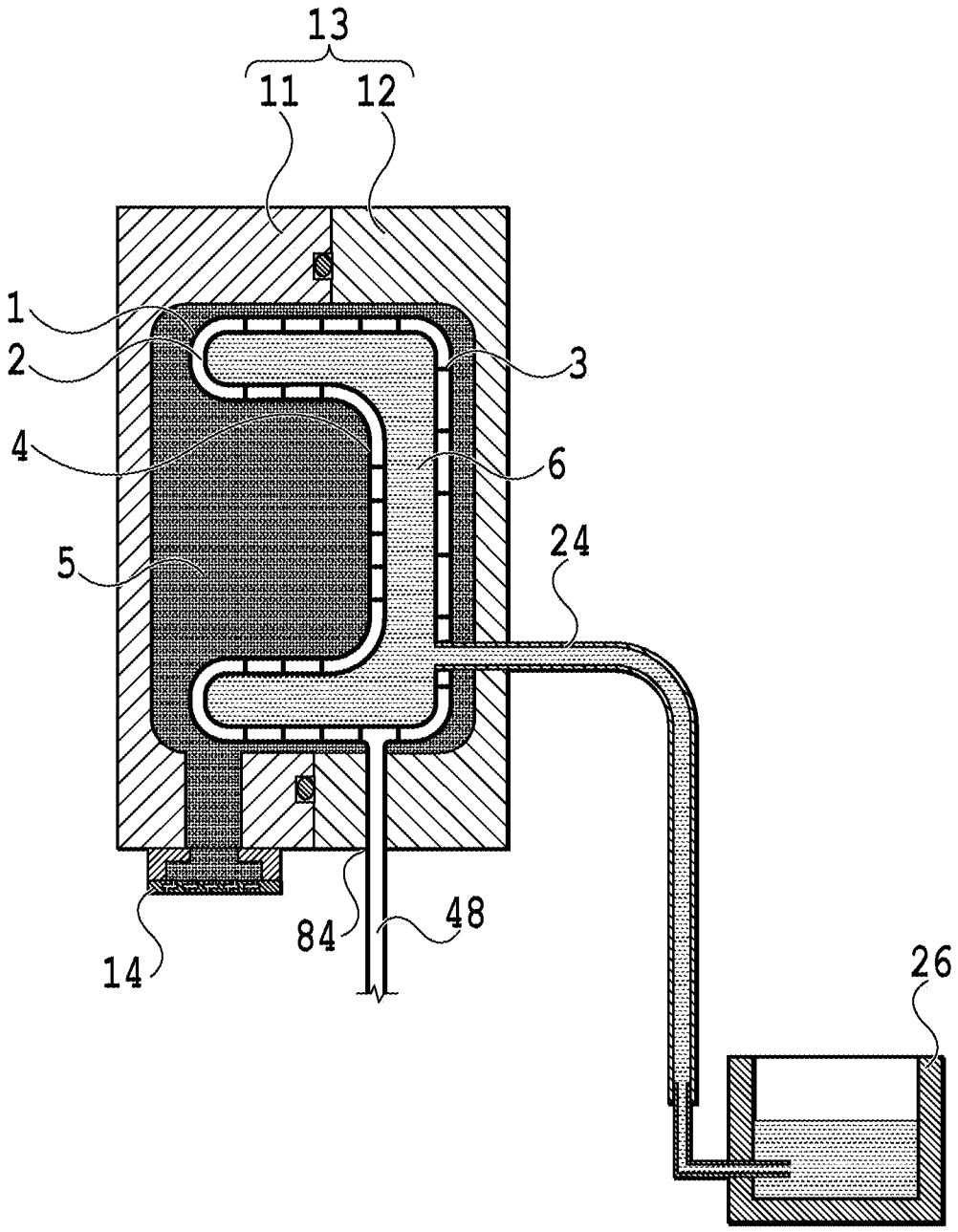
FIG. 32 is a configuration diagram of an ejection apparatus in a 18th embodiment of the present invention.

FIG. 32 is a diagram for explaining an 18th embodiment of the present invention. As in the above fourth embodiment in FIG. 11, two layers of films 1 and 2 forming a bag is disposed in a storing container 13, and the outside of the bag is defined as a first storing space 5 for the ejection liquid while the inside of the bag is defined as a second storing space 6 for the operating liquid. As in the 16th embodiment, a liquid leakage sensor 43, a flow speed meter 102, a pressure measurement gauge 103, and a discharge pump 49 are connected to a discharge tube 48. Alternatively, as in the 17th embodiment, a color sensor 104 and a mist collector 106 may be additionally connected. In this embodiment too, film damage can be detected with the flow speed meter 102, as in the above 16th and 17th embodiments.

Other Embodiments

In the embodiments of the present invention, leakage of at least one of the ejection material and the operating liquid into the inter-film space and a change in internal pressure of the inter-film space are detected as changes in state of the inter-film space resulting from communication between at least one of the first storing space and the second storing space and the inter-film space. The changes in state of the inter-film space are not particularly limited only to leakage of at least one of the ejection material and the operating liquid and a change in internal pressure as mentioned above but may be, for example, a change of components of the gas inside the inter-film space, a change in temperature of the inter-film space, a change in humidity of the inter-film space, and so on. In sum, it is only necessary to be able to detect a change in state of the inter-film space that occurs when at least one of the first storing space and the second storing space and the inter-film space communicate with each other due to damage of at least one of the first film and the second film, which constitute the flexible membrane, or the like.

Also, changes in multiple states of the inter-film space may be detected. This detection of changes in states of the inter-film space may be done in combination with detection using the liquid level sensor 41 and the flow speed sensor 77 as illustrated in FIG. 1 or the like or may be done alone.

Although preferred embodiments of the present invention have been described above, the present invention is not limited to these embodiments. Various modifications and changes can be made without departing from the gist of the present invention. Combinations of some or all of the components discussed in the embodiments are also encompassed within the scope of embodiments of the present invention.

Also, various detectors such as liquid level sensors, flow speed sensor, and flow rate sensor have been presented in the embodiments. These detectors are used as means for detecting the occurrence of a pressure change resulting from at least one of inflow of a gas from the inter-film space into the first storing space or the second storing space and leakage of a liquid from the first storing space or the second storing space into the inter-film space that are caused by film damage. These detectors can be used alone or in combination as desired. Using them in combination enhances the effect of preventing failure to detect film damage.

Also, the liquid level sensor in the eighth embodiment has been described as a displacement sensor having both the function of upper limit and lower limit sensors and the function of a displacement sensor. However, in the case of using the liquid level sensor along with another detector, this other detector may be used for film damage detection while the liquid level sensor may be used simply as upper limit and lower limit sensors that detect the upper limit and the lower limit only for the purpose of liquid level adjustment.

In the above embodiments, the flexible member has been described as a member including two films, namely, a first film and a second film in a layered configuration. However, in the present invention, the number of films functioning as barriers may only need to be two or more and is not limited to two. A configuration with three or more films can also achieve the same advantageous effect as the configuration with two films as long as the adjacent films are partly connected by linking portions 3, have non-fixed regions on their joining surfaces, and also hold the relation that allows them to move together.

In the examples described hereinabove, upon damage of the first film 1 or the second film 2, the pressure inside the first storing space 5 or the second storing space 6 changes, and this pressure change is detected. Note, however, that the present invention is not limited to these examples. The present invention can bring about a similar advantageous effect even if a spot in the first storing space 5 or the second storing space 6 other than the first film 1 or the second film 2 is damaged and a gas flows into the storing space from the damaged spot or a liquid leaks from the storing space. For example, even when part of the housing 11 or the housing 12 in FIG. 1 is damaged, the first storing space 5 and the second storing space 6 are likewise at negative pressure relative to the outside space. Thus, the outside air is sucked into the first storing space 5 or the second storing space 6 from the damaged spot and pushes out the operating liquid inside the second storing space 6 toward the sub tank 26 through the tube 24. As a result, the liquid level inside the sub tank 26 changes. Thus, the damage can be detected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2017-230766, No. 2017-230287, filed Nov. 30, 2017, No. 2018-136707, filed Jul. 20, 2018, and No. 2018-198690 filed Oct. 22, 2018 which are hereby incorporated by reference wherein in their entirety.

REFERENCE SIGNS LIST

1 first film
2 second film
4 inter-film space
5 first storing space
6 second storing space
14 ejection head
42 leakage sensor
84 liquid discharge port

The invention claimed is:

1. An ejection-material ejection apparatus comprising:

an ejection head configured to eject an ejection material;

a storing container configured to be separated by a flexible membrane into a first storing space storing the ejection material to be supplied to the ejection head, and a second storing space storing an operating liquid; and a first pressure controller configured to control internal pressure of the second storing space, wherein the flexible membrane includes a first film covering the first storing space, a second film covering the second storing space, and an inter-film space situated between the first film and the second film, and wherein the ejection-material ejection apparatus further comprises a detector configured to detect a change in a state of the inter-film space resulting from communication between at least one of the first storing space and the second storing space and the inter-film space, and wherein the first film and the second film are joined to each other so as to be movable together.

2. The ejection-material ejection apparatus according to claim 1, wherein the change in the state is leakage of at least one of the ejection material and the operating liquid as a leaking liquid into the inter-film space, and wherein the detector detects the leaking liquid.

3. The ejection-material ejection apparatus according to claim 2, further comprising a liquid discharge port configured to discharge the leaking liquid in the inter-film space to an outside.

4. The ejection-material ejection apparatus according to claim 3, further comprising a sucker configured to suck the leaking liquid in the inter-film space and discharge the leaking liquid from the liquid discharge port.

5. The ejection-material ejection apparatus according to claim 3, wherein the detector is provided at a position where the detector contacts the leaking liquid discharged from the liquid discharge port.

6. The ejection-material ejection apparatus according to claim 3, further comprising a leaking-liquid storing unit configured to store the leaking liquid discharged from the liquid discharge port.

7. The ejection-material ejection apparatus according to claim 6, wherein the detector is provided at a position where the detector contacts the leaking liquid stored in the leaking-liquid storing unit.

8. The ejection-material ejection apparatus according to claim 6, wherein the detector detects a liquid level of the leaking liquid stored in the leaking-liquid storing unit.

9. The ejection-material ejection apparatus according to claim 3, wherein at least one of the first film and the second film includes a recessed portion or a protruding portion.

10. The ejection-material ejection apparatus according to claim 1, wherein the detector is capable of detecting the ejection material and the operating liquid while distinguishing one from the other.

11. The ejection-material ejection apparatus according to claim 10, wherein the detector includes a first detection unit that detects the ejection material and a second detection unit that detects the operating liquid.

12. The ejection-material ejection apparatus according to claim 1, wherein the first pressure controller controls the internal pressure of the second storing space by moving the operating liquid between the second storing space and an outside.

13. An imprinting apparatus that processes a substrate by transferring a pattern on a mold to an imprint material applied to the substrate, comprising the ejection-material ejection apparatus according to claim 1, which ejects the imprinting material as the ejection material to apply the imprint material to the substrate.

14. A ejection-material ejection apparatus comprising:

an ejection head configured to eject an ejection material;

a storing container configured to be separated by a flexible membrane into a first storing space storing the ejection material to be supplied to the ejection head, and a second storing space storing an operating liquid; and a first pressure controller configured to control internal pressure of the second storing space, wherein the flexible membrane includes a first film covering the first storing space, a second film covering the second storing space, and an inter-film space situated between the first film and the second film, wherein the ejection-material ejection apparatus further comprises a detector configured to detect a change in a state of the inter-film space resulting from communication between at least one of the first storing space and the second storing space and the inter-film space, and wherein the change in the state is a change in internal pressure of the inter-film space, and wherein the detector detects the change in the internal pressure.

15. The ejection-material ejection apparatus according to claim 14, further comprising a second pressure controller capable of adjusting the internal pressure of the inter-film space to a lower pressure than internal pressure of the first storing space and the internal pressure of the second storing space.

16. The ejection-material ejection apparatus according to claim 14, wherein the first film and the second film are joined to each other so as to be movable together.

17. A ejection-material ejection apparatus comprising:

an ejection head configured to eject an ejection material;

a storing container configured to be separated by a flexible membrane into a first storing space storing the ejection material to be supplied to the ejection head, and a second storing space storing an operating liquid; and a first pressure controller configured to control internal pressure of the second storing space, wherein the flexible membrane includes a first film covering the first storing space, a second film covering the second storing space, and an inter-film space situated between the first film and the second film, wherein the ejection-material ejection apparatus further comprises a detector configured to detect a change in a state of the inter-film space resulting from communication between at least one of the first storing space and the second storing space and the inter-film space, and wherein the detector detects at least one of an amount and a speed of the operating liquid moving between the second storing space and the first pressure controller.

18. The ejection-material ejection apparatus according to claim 17, wherein the detector detects at least one of the amount and the speed of the operating liquid flowing through a tube through which the second storing space and the first pressure controller communicate with each other.

19. The ejection-material ejection apparatus according to claim 17, wherein the first pressure controller includes a liquid storing unit that communicates with the second storing space and holds the operating liquid, and wherein the detector detects displacement of the operating liquid inside the liquid storing unit.

20. An ejection-material ejection apparatus comprising:

an ejection head configured to eject an ejection material;

a storing container configured to be separated by a flexible membrane into a first storing space storing the ejection material to be supplied to the ejection head, and a second storing space storing an operating liquid; and a first pressure controller configured to control internal pressure of the second storing space, wherein the flexible membrane includes a first film covering the first storing space, a second film covering the second storing space, and an inter-film space situated between the first film and the second film, wherein the ejection-material ejection apparatus further comprises a detector configured to detect a change in a state of the inter-film space resulting from communication between at least one of the first storing space and the second storing space and the inter-film space, wherein the change in the state is leakage of at least one of the ejection material and the operating liquid as a leaking liquid into the inter-film space, wherein the detector detects the leaking liquid, wherein the ejection-material ejection apparatus further comprising a liquid discharge port configured to discharge the leaking liquid in the inter-film space to an outside, and wherein the detector is a flow speed detector that detects flow speed of the leaking liquid from the liquid discharge port.

* * * * *